US012329220B2

(12) United States Patent
Morgan

(10) Patent No.: US 12,329,220 B2
(45) Date of Patent: Jun. 17, 2025

(54) APPAREL LAYER SYSTEM

(71) Applicant: NIKE, Inc., Beaverton, OR (US)

(72) Inventor: Daniel Morgan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 137 days.

(21) Appl. No.: 18/305,116

(22) Filed: Apr. 21, 2023

(65) Prior Publication Data

US 2023/0248097 A1 Aug. 10, 2023

Related U.S. Application Data

(63) Continuation of application No. 17/002,188, filed on Aug. 25, 2020, now Pat. No. 11,659,878, which is a
(Continued)

(51) Int. Cl.
*A41D 31/02* (2019.01)
*A41D 13/00* (2006.01)
(Continued)

(52) U.S. Cl.
CPC ..... *A41D 27/285* (2013.01); *A41D 13/00* (2013.01); *A41D 13/005* (2013.01); *A41D 27/28* (2013.01);
(Continued)

(58) Field of Classification Search
CPC ..... A41D 27/00; A41D 27/28; A41D 27/285; A41D 2300/30; A41D 2500/20;
(Continued)

(56) References Cited

U.S. PATENT DOCUMENTS 2,580,323 A 12/1951 Russell
3,206,766 A 9/1965 Smith
(Continued)

FOREIGN PATENT DOCUMENTS

AU 7266787 A 1/1988
CN 2215203 Y 12/1995
(Continued)

OTHER PUBLICATIONS

Intention to Grant received for European Application No. 18779523.2, mailed on Dec. 20, 2023, 8 pages.
(Continued)

*Primary Examiner* — Katherine M Moran
(74) *Attorney, Agent, or Firm* — SHOOK, HARDY & BACON L.L.P.

(57) ABSTRACT

Aspects herein are directed to an apparel layer system configured to provide variable levels of insulation, warming, or air permeability. The apparel layer system comprises a first layer of material and a second layer of material both extending in a first planar direction. A third layer of material is positioned between the first and the second layers of material and is selectively affixed thereto. An adjustment mechanism coupled to the second layer of material can be mechanically manipulated to shift the second layer of material between different positions or states to achieve variable levels of offset between the first and second layers of material in the first planar direction and in a second direction perpendicular to the first planar direction.

19 Claims, 13 Drawing Sheets

Related U.S. Application Data continuation of application No. 16/117,724, filed on Aug. 30, 2018, now Pat. No. 10,786,023.

(60) Provisional application No. 62/557,806, filed on Sep. 13, 2017.

(51) Int. Cl.

| | |
|---|---|
| ***A41D 13/005*** | (2006.01) |
| ***A41D 27/28*** | (2006.01) |
| ***A41D 31/00*** | (2019.01) |
| ***A41D 31/06*** | (2019.01) |
| ***A41D 31/14*** | (2019.01) |

(52) U.S. Cl.

CPC ..... *A41D 31/00* (2013.01); *A41D 31/02* (2013.01); *A41D 31/065* (2019.02); *A41D 31/145* (2019.02); *A41D 2300/322* (2013.01); *A41D 2500/20* (2013.01); *A41D 2500/30* (2013.01)

(58) Field of Classification Search

CPC ..... A41D 13/002; A41D 13/005; A41D 31/0033; A41D 31/0038; A41D 31/065; A41D 31/145; A41D 31/02; A62B 17/00; D04B 1/10

See application file for complete search history.

(56) References Cited

U.S. PATENT DOCUMENTS

| | | | | |
|---|---|---|---|---|
| 4,185,327 | A | 1/1980 | Markve | |
| 4,513,451 | A | 4/1985 | Brown | |
| 4,722,099 | A | 2/1988 | Kratz | |
| 5,704,064 | A | 1/1998 | van der Sleesen | |
| 5,953,834 | A | 9/1999 | Clodic | |
| 6,009,560 | A | 1/2000 | McKenney et al. | |
| 6,263,510 | B1 | 7/2001 | Bay et al. | |
| 6,904,618 | B2 | 6/2005 | Musal | |
| 7,140,048 | B2 | 11/2006 | Wallerstein | |
| 7,412,728 | B2 | 8/2008 | Alesina et al. | |
| 7,827,624 | B1 | 11/2010 | Cole | |
| 7,865,973 | B1 | 1/2011 | Gibson | |
| 8,756,714 | B2 | 6/2014 | Reimer | |
| 10,786,023 | B2 | 9/2020 | Morgan | |
| 2004/0194190 | A1 | 10/2004 | Gathings | |
| 2005/0273903 | A1 | 12/2005 | Rudman | |
| 2006/0192642 | A1* | 8/2006 | Ruiz | A41F 1/002 335/207 |
| 2007/0000001 | A1 | 1/2007 | Tomann et al. | |
| 2009/0155543 | A1 | 6/2009 | Fowler | |
| 2010/0218301 | A1 | 9/2010 | Messiou | |
| 2011/0274858 | A1 | 11/2011 | Kapur et al. | |
| 2012/0204315 | A1 | 8/2012 | Lambertz | |
| 2013/0014317 | A1 | 1/2013 | Ly | |
| 2013/0309929 | A1 | 11/2013 | Thiet | |
| 2014/0157497 | A1 | 6/2014 | Audet | |
| 2014/0304896 | A1 | 10/2014 | Nordstrom et al. | |
| 2016/0150845 | A1 | 6/2016 | Leedom et al. | |
| 2016/0278459 | A1 | 9/2016 | Hilty | |
| 2018/0177248 | A1 | 6/2018 | Sneath et al. | |
| 2019/0075868 | A1 | 3/2019 | Morgan | |
| 2020/0015530 | A1 | 1/2020 | Baker | |
| 2020/0221810 | A1 | 7/2020 | Polegato Moretti et al. | |
| 2020/0383409 | A1 | 12/2020 | Morgan | |
| 2022/0030992 | A1 | 2/2022 | Koshkaroff et al. | |

FOREIGN PATENT DOCUMENTS

| | | | |
|---|---|---|---|
| CN | 108366631 | A | 8/2018 |
| DE | 4128704 | A1 | 3/1993 |
| GB | 540545 | A | 10/1941 |
| GB | 2234705 | A | 2/1991 |
| JP | 2000073216 | A | 3/2000 |
| WO | 2005/032289 | A2 | 4/2005 |
| WO | 2010/050822 | A3 | 7/2010 |
| WO | 2016/044872 | A1 | 3/2016 |
| WO | 2016/191060 | A1 | 12/2016 |

OTHER PUBLICATIONS

International Preliminary Report on Patentability received for PCT Patent Application No. PCT/US2018/050565, dated Mar. 26, 2020, 8 pages.

International Search Report and Written Opinion dated Nov. 21, 2018 in International Patent Application No. PCT/US2018/050565, 15 pages.

Office Action received for European Application No. 18779523.2, mailed on Jan. 18, 2022, 6 pages.

"Exxtreme Jacket—Mens", Dragon Wear from True North Gear, Available online at <https://web-beta.archive.org/web/20160815140825/http://www.dragonwear.com:80/catalog/products/outerwear/exxtreme-jacket-mens>, Accessed on Aug. 15, 2016, 1 page.

"GP-R Leather Jacket", Alpinestars, Available online at <http://web.archive.org/web/20170102192223/http://www.alpinestars.com/gp-r-leather-jackel#.WN3we_nyvIU>, Accessed on Aug. 15, 2016, 5 pages.

"Jasper Flex Men", Hardshell Men, Jack Wolfskin, Available online at <http://web.archive.org/web/20170331062256/http://www.jack-wolfskin.com/jasper-flex-men/1108371-1588002.html>, Accessed on Mar. 31, 2017, 3 pages.

"Sonic 2.0.—Joe Rocket", joerocket.com, Available online at <http://web.archive.org/web/20170331055533/http://www.joerocket.com/leather-jackets-2/sonic2>, Accessed on Mar. 31, 2017, 3 pages.

EP Communication received for European Application No. 24176089.1, mailed on Oct. 21, 2024, 2 pages.

Extended European Search Report received for European Application No. 24176089.1, mailed on Sep. 16, 2024, 9 pages.

* cited by examiner

200

600

APPAREL LAYER SYSTEM

CROSS-REFERENCE TO RELATED APPLICATIONS

This application, having and entitled "Apparel Layer System," is a continuation application of U.S. application Ser. No. 17/002,188, now U.S. Pat. No. 11,659,878, entitled "Apparel Layer System," and filed Aug. 25, 2020, which is a continuation application of U.S. application Ser. No. 16/117,724, now U.S. Pat. No. 10,786,023, filed Aug. 30, 2018, and entitled "Apparel Layer System," which claims the benefit of priority of U.S. Prov. App. No. 62/557,806, entitled "Apparel Layer System," and filed Sep. 13, 2017. The entireties of the aforementioned applications are incorporated by reference herein.

TECHNICAL FIELD

Aspects herein relate to an apparel layer system. More specifically, aspects herein relate to an apparel layer system configured to provide adjustable insulation, warming, and/or permeability.

BACKGROUND

Typical apparel items or garments are structured to provide a fixed level of insulation, warming, and/or a fixed level of air permeability.

BRIEF DESCRIPTION OF THE DRAWINGS

Examples of the present invention are described in detail below with reference to the attached drawing figures, wherein.

DETAILED DESCRIPTION

Figures 1A, 1B, 1C:
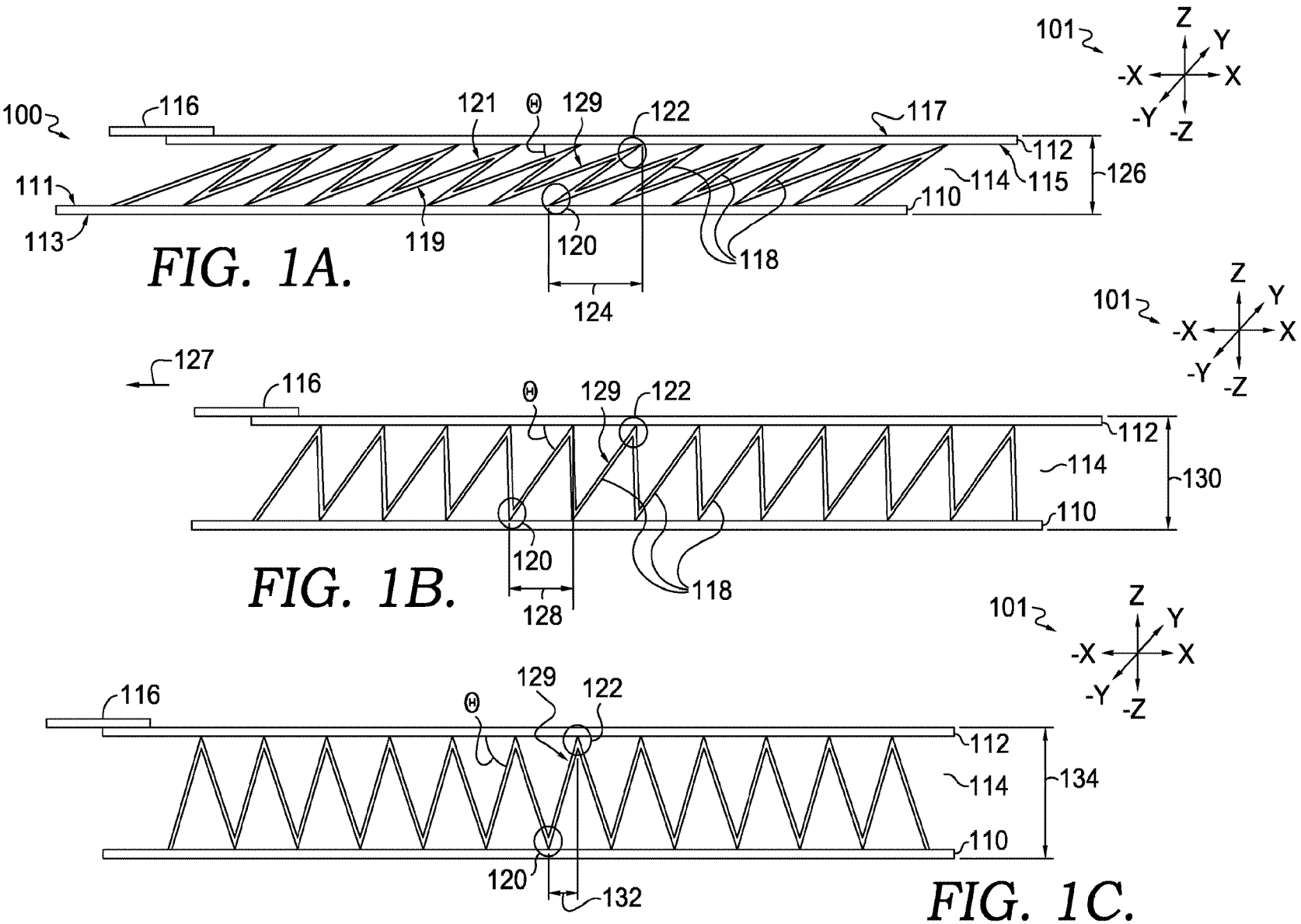
FIG. 1A illustrates a side view of an example apparel layer system in a first state in accordance with aspects herein.
FIG. 1B illustrates a side view of the example layer system of FIG. 1A in a second state in accordance with aspects herein.
FIG. 1C illustrates a side view of the example layer system of FIG. 1A in a third state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to an apparel layer system that can be used to provide variable and adjustable levels of insulation, warming, or air permeability. In example aspects, the apparel layer system may be integrated into a garment such as a top or a bottom or an apparel item such as a hat, sock, or the like. In one instance, the apparel layer system may be in the form of a panel piece or trim piece that is integrated into the garment or apparel item by affixing the trim piece to one or more garment portions or apparel item portions. In another instance, the apparel layer system may be integrally created through modifying the knitting, weaving, or construction process used to form the garment or apparel item.

In general, the apparel layer system comprises a first layer of material, a second layer of material, and a third layer of material. At least the first layer of material and the second layer of material extend in a first planar direction. The third layer of material is interposed between the first layer of material and the second layer of material such that a first surface of the third layer is positioned adjacent to a first surface of the first layer of material and is selectively affixed thereto. And a second opposite surface of the third layer of material is positioned adjacent to a first surface of the second layer of material and is selectively affixed thereto. An adjustment mechanism is coupled to the second layer of material.

Continuing, in example aspects, the adjustment mechanism can be mechanically manipulated between a plurality of positions which, in turn causes the second layer to be mechanically shifted or transitioned between different positions or states. In another example, the adjustment mechanism may automatically transition between the plurality of positions upon exposure to a stimulus such as, for example, moisture. When the adjustment mechanism is in a first position, the second layer is offset from the first layer in the first planar direction by a first amount, and the second layer is offset from the first layer in a second direction perpendicular to the first planar direction by a first amount. When the adjustment mechanism is in a second position, the second layer is offset from the first layer in the first planar direction by a second amount that is less than the first amount. As well, when the adjustment mechanism is in the second position, the second layer is offset from the first layer in the second direction perpendicular to the first planar direction by a second amount that is greater than the first amount.

The changes in offset (both in the first direction and the second direction) of the first and second layers are possible due to the selective attachment of the third layer of material to the first and second layers. In one example aspect, the third layer may be manipulated to form a series of folds with the long axis of the folds being in parallel with each other and perpendicular to a tension force exerted by the adjustment mechanism when mechanically manipulated. The apex regions of the folds are selectively attached to the surfaces of the first and second layers. As used throughout this disclosure, the term "apex region" may be generally defined as the region at which a material folds or bend over on itself so that one portion of the material covers (or is configured to cover) another portion of the material. The apex region may comprise a distinct bend or fold (i.e., a distinct point or apex) or may comprise a more general region (i.e., a more gradual fold). Continuing, when the adjustment mechanism is in, for instance, the first position, the folds extend generally in the first planar direction (i.e., they lie flat). However, when the adjustment mechanism is in the second position, the movement of the second layer causes the folds to extend generally in a direction that is non-planar to the first planar direction (i.e., they stand upright or partially upright). This causes a greater amount of vertical offset (i.e., offset in the z-direction) between the first and second layers of material.

The general construction described above may be used to provide variable levels of air permeability, warming, or insulation depending on the types of materials used to form the different layers. For instance, in example aspects, when the apparel layer system is configured to provide variable insulation, the different layers may be formed from a material that limits air movement through the material (e.g., a tightly woven material). When a relatively low level of insulation is desired, the adjustment mechanism may be maintained in the first position causing a small amount of vertical offset between the first and second layers. However, when a relatively greater level of insulation is needed (i.e., a level of insulation greater than when the adjustment mechanism is in the first position), the adjustment mechanism may be moved to the second position such that the vertical offset between the first and second layers is increased. This, in turn, creates an air pocket between the layers that can be used to trap and store heated air thus helping to insulate the wearer.

When the apparel layer system is configured to provide variable air permeability, at least the first and second layers of material may comprise perforations or apertures in select locations. When a relatively low level of air permeability is desired, such as when a wearer is at rest, the adjustment mechanism may be maintained in the first position. The placement of the apertures on the first and second layers of material is such that the apertures of the first layer are offset from (i.e., not aligned with) the apertures in the second layer when the adjustment mechanism is in the first position. This limits the flow of air through the layers. However, when a relatively greater amount of air permeability is desired, such as when the wearer is exercising, the adjustment mechanism may be moved to the second position. When the adjustment mechanism is in the second position, the apertures in the first layer align, or at least partially align, with the apertures in the second layer to facilitate the flow of air through the different layers. To further facilitate air flow between the layers, the third layer may be formed of a mesh material or from a material having apertures.

In example aspects, the apparel layer system may be configured to provide variable levels of warming. In this aspect, the third layer of material may comprise a reflective material or a material having a reflective deposit on at least the first surface of the third layer of material (i.e., the surface that faces toward the first layer of material). When a relatively moderate level of radiant warming is desired, the adjustment mechanism may be maintained in the first position. In this position, the reflective surface of the third layer of material is generally planar or extends in the first planar direction such that it is parallel or generally parallel to a wearer's body surface when the apparel layer system is incorporated into a garment or an apparel item. Thus, any radiant heat energy generated by the wearer may be reflected back toward the body surface of the wearer via the reflective surface. When warming is no longer necessary, the adjustment mechanism may be transitioned to the second position such that the reflective surface of the third layer of material is no longer planar with respect to the wearer's body surface. A result of this is that less heat is reflected back to the wearer and warming is reduced.

The variable warming feature may be combined with the variable permeability feature discussed above by including apertures in the first layer of material and the second layer of material. Thus, when radiant warming and limited air permeability is desired, the adjustment mechanism may be maintained in the first position, which causes the apertures in the first and second layers of material to be offset from each other limiting air movement through the apparel layer system. However, as described, when the third layer of material comprises a reflective surface, maintaining the adjustment mechanism in the first position causes the reflective surface to be relatively planar with respect to the wearer's body surface thereby promoting reflection of radiant heat produced by the wearer back to the wearer's body surface. When increased air permeability and decreased warming is desired, the adjustment mechanism may be transitioned to the second position causing the apertures in the first and second layer to align, or partially align, and further causing the reflective surface of the third layer of material to no longer be planar with respect to the wearer's body surface. The result is that air permeability through the aligned apertures is increased, and radiant energy produced by the wearer is no longer reflected back to the wearer's body surface.

The provision of variable levels of insulation, warming, and air permeability may also be facilitated by the use of an adjustment mechanism that is configured to be incrementally adjusted. For instance, in one example aspect, the adjustment mechanism may comprise a first magnetic strip having alternating and repeating magnetic elements (i.e., alternating and repeating North and South poles) that is coupled to the second layer of the apparel layer system. A complementary second magnetic strip, also having alternating and repeating magnetic elements, may be applied to the garment such that it is positioned to be in contact with the first magnetic strip.

The movement of the first magnetic strip may be initiated by a mechanical pulling force (e.g., a wearer's fingers) having sufficient magnitude to overcome the attraction force between the magnetic elements located on the different strips. Once movement is initiated, the movement of the first magnetic strip is constrained by the second magnetic strip such that the two strips are maintained in an abutting relationship and slidably move relative to one another in discrete steps guided by the alternating and repeating magnetic elements of the strips. The use of this configuration enables the second layer of the apparel layer system to be shifted in incremental steps in relation to the first layer of the apparel layer system. In turn, the amount of vertical offset between the first and second layers when the apparel layer system is used for insulation, or the amount of alignment between the apertures of the first and second layers when the apparel layer system is used for permeability, or the amount of reflective surface exposed to the wearer's body surface can be incrementally controlled to provide fine-tuning of insulation levels, permeability levels, and warming levels respectively.

Accordingly, aspects herein are directed to an apparel layer system comprising a first layer extending in a first planar direction, a second layer extending in the first planar direction, and a third layer positioned between the first layer and the second layer. The third layer has a first surface and a second surface opposite the first surface, where the first surface is positioned adjacent the first layer and the second surface is positioned adjacent the second layer. Further, the first surface of the third layer is selectively affixed to the first layer and the second surface is selectively affixed to the second layer. The apparel layer system further comprises an adjustment mechanism coupled to the second layer, where when the adjustment mechanism is in a first position, the second layer is offset from the first layer by a first amount, and when the adjustment mechanism is in a second position, the second layer is offset from the first layer by a second amount.

In another aspect, an apparel layer system is provided comprising a first layer having a first aperture, where the first layer extends in a first planar direction. The apparel layer system further comprises a second layer having a second aperture, where the second layer extends in the first planar direction. Additionally, the system comprises a third layer positioned between the first layer and the second layer, where the third layer has a first surface and a second surface opposite the first surface. The first surface is positioned adjacent the first layer and the second surface is positioned adjacent the second layer; the first surface is selectively affixed to the first layer and the second surface is selectively affixed to the second layer. The apparel layer system also comprises an adjustment mechanism coupled to the second layer. When the adjustment mechanism is in a first position the first aperture is offset from the second aperture, and when the adjustment mechanism is in a second position, the first aperture is aligned with the second aperture.

Aspects herein are also directed to a method of manufacturing an apparel layer system. The method comprises providing a first layer of material, providing a second layer of material, and providing a third layer of material, where the third layer of material has a first surface and a second surface opposite the first surface. The third layer of material is manipulated to form a set of folds. The first surface of the third layer of material is selectively attached to a first surface of the first layer of material, and the second surface of the third layer of material is selectively attached to a first surface of the second layer of material. The method also comprises coupling an adjustment mechanism to the second layer of material. When the adjustment mechanism is in a first position, the set of folds are in a generally planar relationship with the first layer of material and the second layer of material, and when the adjustment mechanism is in a second position, the set of folds are in a generally non-planar relationship with the first layer of material and the second layer of material.

As used throughout this disclosure, positional terms such as "anterior," "posterior," "front," "back," "side," "lateral," "medial," "inner-facing surface," "outer-facing surface," and the like are to be given their common meaning with respect to the apparel layer system as incorporated in a garment or apparel item being worn as intended by a hypothetical wearer standing in an upright position (i.e., standing in anatomical position) and as shown and described herein. Still further, the phrase "configured to contact," "adapted to contact," or other similar phrases used when describing different portions of the apparel layer system and/or the garment and/or the apparel item in relation to a wearer refer to an apparel layer system and/or a garment and/or apparel item that is appropriately sized for the particular wearer. Terms such as "affixed," "secured," "coupled," and the like may mean releasably securing two or more elements together using affixing technologies such as zippers, hook-and-loop fasteners, releasable adhesives, buttons, snaps, and the like. These terms may also mean permanently affixing two or more elements together using technologies such as stitching, bonding, welding, gluing, and the like.

Turning now to FIG. 1A, a side view of an example layer system 100 in a first state is provided in accordance with aspects herein. The apparel layer system 100, in example aspects, may comprise a first layer of material 110, a second layer of material 112, and a third layer of material 114 interposed or positioned between the first layer of material 110 and the second layer of material 112. The first layer of material 110 may comprise a first surface 111 and a second surface 113 opposite the first surface 111, and the second layer of material 112 may comprise a first surface 115 and a second surface 117 opposite the first surface 115. Similarly, the third layer of material 114 may comprise a first surface 119 and a second surface 121 opposite the first surface 119.

Continuing, when the third layer of material 114 is interposed or positioned between the first and second layers of material 110/112, the first surface 119 of the third layer of material 114 may be positioned generally adjacent to the first surface 111 of the first layer of material 110 and selectively affixed thereto. Further, the second surface 121 of the third layer of material 114 may be positioned generally adjacent to the first surface 115 of the second layer of material 112 and selectively affixed thereto. In one example aspect, the third layer of material 114 comprises a series of folds 118 (seen from the side in FIG. 1A). Each fold 118 may comprise a first apex region 120 and an opposite second apex region 122. To selectively affix the first surface 119 of the third layer of material 114 to the first surface 111 of the first layer of material 110, the first apex region 120 of the folds 118 may be affixed to the first surface 111 of the first layer of material 110 using, for example, stitching, bonding, spot welding, an adhesive, and the like. To selectively affix the second surface 121 of the third layer of material 114 to the first surface 115 of the second layer of material 112, the second apex region 122 may be affixed to the first surface 115 of the second layer of material 112 using, for example, stitching, bonding, spot welding, an adhesive, and the like. In this example, the remaining portions of the third layer of material 114 remain unaffixed from the first and second layers of material 110/112. To describe it a different way, except for the first and second apex regions 120/122, the folds 118 remain generally unaffixed from or unattached to the first and second layers of material 110/112.

In example aspects, the first layer of material 110 extends in a first planar direction with reference to Cartesian coordinate system 101. To describe it a different way, the first layer of material 110 extends in the direction of its surface plane, where the surface plane of the first layer of material 110 can be described as a two-dimensional plane having an x direction and a y direction. As well, the second layer of material 112 also extends in the first planar direction. In other words, the second layer of material 110 extends in the direction of its surface plane, where the surface plane of the second layer of material 112 can also be described as a two-dimensional plane having an x direction and a y direction. As such, the surface plane of the second layer of material 112 is generally parallel to and offset from the surface plane of first layer of material 110.

When the apparel layer system 100 is in a first state, the folds 118 of the third layer of material 114 are folded (i.e., the portions of the folds 118 between their respective apex regions 120 and 122 generally abut, or touch each other, or are positioned adjacent to one another such that the folds 118 generally lie flat). For clarity, the folds 118 in FIG. 1A are not shown touching each other. When folded, the folds 118 of the third layer of material 114 also generally extend in the first planar direction and an angle, e, formed between, for instance, a fold 118 and the second layer of material 112 (or first layer of material 110) may be less than, for example, 10 degrees. To describe it further, with respect to a particular fold 129, the second apex region 122 of the fold 129 may be described as extending in the positive x-direction, and the first apex region 120 of the fold 129 may be described as extending in the negative x-direction with respect to the Cartesian coordinate system 101.

In the first state as shown in FIG. 1A, the second layer of material 112 is offset from the first layer of material 110 in the first planar direction by a first amount 124. More particularly, consider the fold 129, where the second apex region 122 is positioned in a positive x-direction with respect to the first apex region 120 of the fold 129. With this as context, the second apex region 122 of the fold 129 is offset from the first apex region 120 in the first planar direction by the first amount 124. And because the first and second apex regions 120/122 are fixedly attached to the first and second layers of material 110/112 respectively, this also means that the second layer of material 112 is offset from the first layer of material 110 in the first planar direction by the first amount 124. Further, in the first state, the second layer of material 112 is offset by a first amount 126 from the first layer of material 110 in a second direction perpendicular to the first planar direction. To describe it a different way with respect to the Cartesian coordinate system 101, the second layer of material 112 is offset from the first layer of material 110 in the positive z-direction by the first amount 126.

Additionally, the apparel layer system 100 may comprise an adjustment mechanism 116 coupled to the second layer of material 112. As will be explained in greater depth below, the adjustment mechanism 116 may be used to shift the second layer of material 112 relative to the first layer of material 110 via the third layer of material 114.

FIG. 1B illustrates the apparel layer system 100 in a second state in accordance with aspects herein. The second state may be achieved by exerting a tension force 127 on the adjustment mechanism 116 in a direction opposite to the direction in which the second apex regions 122 extend. With respect to FIG. 1A, for example, the tension force 127 may be exerted in the negative x-direction while the second apex regions 122 extend in the positive x-direction. Depending on the orientation of the apparel layer system 100 though, the directions may differ. For example, the tension force 127 may be in the positive x-direction while the second apex regions 122 extend in the negative x-direction. Or the tension force 127 may be in the positive y-direction while the second apex regions 122 extend in the negative y-direction. Or, in another example, the tension force 127 may be in the negative y-direction while the second apex regions 122 extend in the positive y-direction. Any and all aspects, and any variation thereof, are contemplated as being within the scope herein.

Continuing, due to the selective attachment of the third layer of material 114 to the second layer of material 112 via the second apex regions 122 and due to the selective attachment of the third layer of material 114 to the first layer of material 110 via the first apex regions 120, movement of the second layer of material 112 using the adjustment mechanism 116 also causes the second apex regions 122 to move in the negative x-direction while the first apex regions 120 remain stationary (i.e., the first apex regions 120 act as anchor points). Moreover, due to just the second apex regions 122 of the folds 118 being selectively attached to the second layer of material 112, and due to the second apex regions 122 extending in the positive x-direction, movement of the second layer of material 112 in the negative x-direction causes the folds 118 to begin to assume a more upright (or "unfolded") configuration as shown in FIG. 1B. To describe it a different way, movement of the second layer of material 112 in the negative x-direction exerts a force on at least the second apex regions 122 of the folds 118 causing the second apex regions 122 to also move in the negative x-direction thereby causing the folds 118 to assume a more upright configuration. To describe it yet a different way, in the second state, the angle, e, between a fold 118 and the second layer of material 112 may be greater than the angle, e, when the apparel layer system 100 is in the first state. For example, the angle, e, in the second state may be greater than 10 degrees but less than, for example, 15 to 55 degrees.

In the second state as shown in FIG. 1B, the second layer of material 112 is offset from the first layer of material 110 in the first planar direction by a second amount 128. More particularly, the second apex region of the fold 129 is offset from the first apex region 120 of the fold 129 in the first planar direction by the second amount 128. In example aspects, the second amount 128 is less than the first amount 124. In other words, there is less lateral offset in the first planar direction with respect to the apex regions 120/122 when the apparel layer system 100 is in the second state. And because the first and second apex regions 120/122 are fixedly attached to the first and second layers of material 110/112 respectively, this also means that there is less lateral offset in the first planar direction between the second layer of material 112 and the first layer of material 110. Further, in the second state, the second layer of material 112 is offset by a second amount 130 from the first layer of material 110 in the second direction that is perpendicular to the first planar direction (i.e., offset in the positive z-direction). In example aspects, the second amount 130 is greater than the first amount 126. In other words, there is greater vertical offset in the second direction when the apparel layer system 100 is in the second state as shown in FIG. 1B.

FIG. 1C illustrates the apparel layer system 100 in a third state in accordance with aspects herein. The third state may be achieved by continuing to exert the tension force 127 on the adjustment mechanism 116. Continued movement of the second layer of material 112 via the adjustment mechanism 116 in the negative x-direction also causes continued movement of the second apex regions 122 of the third layer of material 114 in the negative x-direction. This movement in the negative x-direction causes the folds 118 to assume a generally upright (or "unfolded") configuration as shown in FIG. 1C. To describe it a different way, in the third state, the angle, e, between a fold 118 and the second layer of material 112 may be greater than the angle, e, when the apparel layer system 100 is in the second state. For example, the angle, e, in the third state may be greater than 55 degrees. The degree measurements provided herein are example only and are used merely to illustrate that the angle, e, between a fold 118 and the second layer of material 112 (or the first layer of material 110) gradually increases as the folds 118 are transitioned to an upright position.

In the third state as shown in FIG. 1C, the second layer of material 112 is offset from the first layer of material 110 in the first planar direction by a third amount 132. More particularly, the second apex region 122 of the fold 129 is offset from the first apex region 120 of the fold 129 in the first planar direction by the third amount 132. In example aspects, the third amount 132 is less than the second amount 128. In other words, there is even less lateral offset in the first planar direction between the two layers of material 110/112 with respect to the apex regions 120/122 when the apparel layer system 100 is in the third state.

Further, in the third state, the first layer of material 112 is offset by a third amount 134 from the first layer of material 110 in the second direction that is perpendicular to the first planar direction (the positive z-direction). In example aspects, the third amount 134 is greater than the second amount 130. In other words, there is an even greater vertical offset in the second direction when the apparel layer system 100 is in the third state as shown in FIG. 1C. To summarize, as the apparel layer system 100 transitions from the first state to the third state, the amount of offset in the first planar direction between the first layer of material 110 and the second layer of material 112 with respect to, for instance, apex regions 120 and 122 of a particular fold 118 gradually decreases while the amount of offset between the first and second layers of material 110/112 in the second direction (the z-direction) gradually increases.

It is contemplated herein that there may be additional states of the apparel layer system 100 other than the states shown in FIGS. 1A-1C. For example, there may be states intermediate between the first state shown in FIG. 1A and the second state shown in FIG. 1B. There also may be states intermediate between the second state shown in FIG. 1B and the third state shown in FIG. 1C. It is also contemplated herein that the adjustment mechanism 116 may be configured to inhibit or stop movement in the negative x-direction once the folds 118 are in a substantially upright position (i.e., in the third state shown in FIG. 1C). However, it is also contemplated herein that the adjustment mechanism 116 may be configured to continue movement in the negative x-direction thus causing the folds 118 to eventually lie flat again but have their second apex regions 122 extend in a negative x-direction and their first apex regions 120 extend in a positive x-direction. Any and all aspects, and any variation thereof, are contemplated as being within aspects herein.

Figure 2:
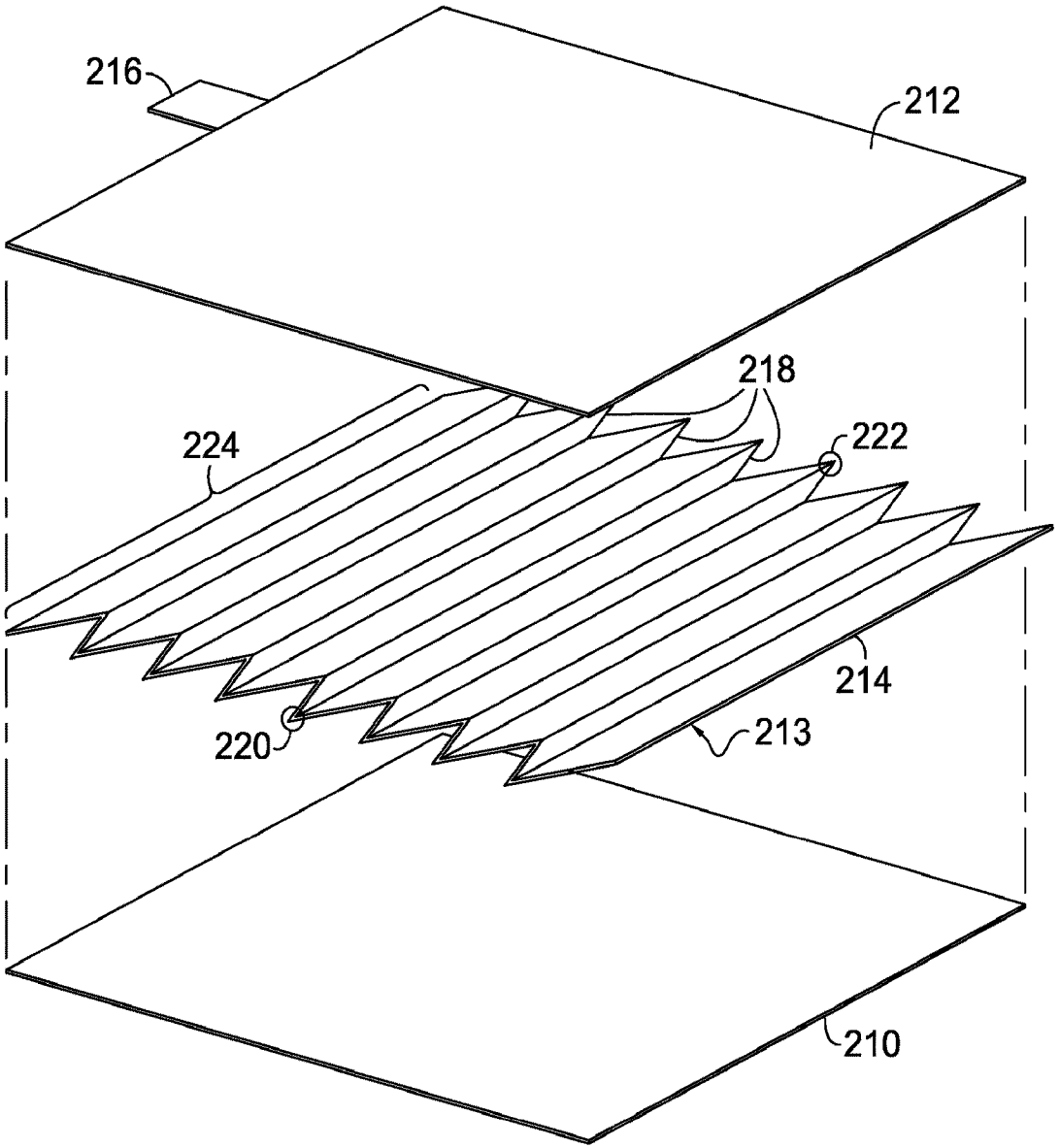
FIG. 2 illustrates an exploded view of an example apparel layer system in accordance with aspects herein.

Turning now to FIG. 2, an exploded view of an apparel layer system, such as the apparel layer system 100, is provided in accordance with aspects herein and is referenced generally by the numeral 200. The apparel layer system 200, in example aspects, may be configured to provide variable levels of insulation and/or variable levels of warming. The apparel layer system 200 comprises a first layer of material 210 extending in a first planar direction, a second layer of material 212 extending in the first planar direction, and a third layer of material 214 positioned between or interposed between the first layer of material 210 and the second layer of material 212. To help provide an insulation effect and to be suitable as an article of apparel, the first layer of material 210 and the third layer of material 214 may comprise, for example, a stretch woven or non-woven material (e.g., 2-way stretch or 4-way stretch) without engineered perforations or apertures. As used throughout this disclosure, the term "engineered" may be defined as formed in a post-material production step. To further help provide a radiant warming effect, at least a first surface 213 of the third layer of material 214 may optionally comprise a reflective deposit, where the first surface 213 is configured to be positioned adjacent to a surface of the first layer of material 210. The reflective deposit may comprise an aluminum-based material, a copper-based material, another metal or metal alloy-based material, or non-metal materials such as metallic plastic, or other man-made materials.

Continuing, the second layer of material 212 may also comprise a woven or non-woven material (stretch or non-stretch) without engineered perforations or apertures, and may more particularly comprise a lightweight woven material. Use of woven material, especially tightly woven materials, and/or use of certain non-woven materials may help to limit movement of air through the different layers. Use of stretch woven or non-woven materials helps to contribute to wearer comfort and freedom-of-movement when the apparel layer system 200 is incorporated into a garment And use of lightweight woven materials may be suitable when the apparel layer system 200 is incorporated into a garment intended to be worn when exercising (e.g., running, and the like). The apparel layer system 200 further comprises an adjustment mechanism 216 coupled to the second layer of material 212.

With respect to the third layer of material 214, the third layer of material 214 comprises a series of folds 218 with each fold having a long axis 224. The long axes 224 of the folds 218 are arranged in parallel to each other. Further, each fold 218 comprises a first apex region 220 and a second apex region 222. In example aspects, the adjustment mechanism 216 is positioned on the second layer of material 212 such that it is configured to exert a tension force that is perpendicular to the long axes 224 of the folds 218. As described above, the first apex regions 220 may be selectively affixed to the first layer of material 210, and the second apex regions 222 of the folds 218 may be selectively affixed to the second layer of material 212.

When the apparel layer system 200 is assembled, it assumes a structure similar to the apparel layer system 100 of FIGS. 1A-1C. As such, when the apparel layer system 200 is in a first state, such as the first state shown in FIG. 1A, the folds 218 extend generally in the first planar direction and, more specifically, the second apex regions 222 may extend in the positive x-direction, the first apex regions 220 may extend in the negative x-direction, and an angle, e, between a fold 218 and, for instance, the second layer of material 212 may be less than, for example, 10 degrees. Because the folds 218 generally lie flat in the first state, there is a small amount of vertical offset between the first and second layers of material 210/212. Thus, configuring the apparel layer system 200 to be in the first state may be useful when a light amount of insulation is needed such as during exercise in cool conditions.

When the third layer of material 214 optionally comprises a reflective deposit on its first surface 213, warming may be provided when the apparel layer system 200 is in the first state. For instance, in the first state, the folds 218 extend generally in the first planar direction (i.e., they lie flat) causing the reflective first surface 213 to be in a generally planar relationship with a body surface of a wearer when the apparel layer system 200 is incorporated into a garment or apparel item. Radiant heat energy produced by the wearer would be reflected back to the wearer's body surface via the reflective first surface 213 of the third layer of material 214 thereby helping to warm the wearer when at rest.

To cause the apparel layer system 200 to provide a higher level of insulation, the adjustment mechanism 216 may be tensioned in, for example, the negative x-direction thereby causing the second apex regions 222 to also move in the negative x-direction due to the selective attachment of the second apex regions 222 to the second layer of material 212, while the first apex regions 220 generally remain stationary (e.g., they do not move in the negative x-direction or the positive x-direction). In example aspects, the movement of the adjustment mechanism 216 may cause the apparel layer system 200 to transition to the second state shown in FIG. 1B. As described, in the second state there is a greater amount of vertical offset (offset in the z-direction) between the first layer of material 210 and the second layer of material 212. The greater amount of vertical offset between the layers 210/212 may help to trap warmed air between the layers 210/212 and provide a higher degree of insulation as compared to the first state. The higher amount of insulation may be useful when the wearer is exercising in colder conditions or is trying to maintain warmth before or after exercise.

A yet greater amount of insulation may be achieved by continuing to tension the adjustment mechanism 216 in the negative x-direction to cause the apparel layer system 200 to transition to a third state such as that shown in FIG. 1C. In the third state, there is yet a greater amount of vertical offset (offset in the z-direction) between the layers 210/212 allowing for a greater space for trapping warmed air. As mentioned earlier, it is contemplated herein that additional states between the first state and the third state may be achieved so that a customizable level of insulation may be provided.

When the third layer of material 214 optionally comprises a reflective deposit on its first surface 213, radiant warming may be reduced when the apparel layer system 200 is in the second or third state to prevent overheating the wearer. For instance, in the second or third state, the folds 218 extend generally in the second direction generally perpendicular to the first planar direction causing the reflective first surface 213 to be in a generally perpendicular relationship with a body surface of a wearer when the apparel layer system 200 is incorporated into a garment or apparel item. Reflection of radiant heat energy produced by the wearer would thereby be reduced with a subsequent reduction in radiant warming.

Figure 3:
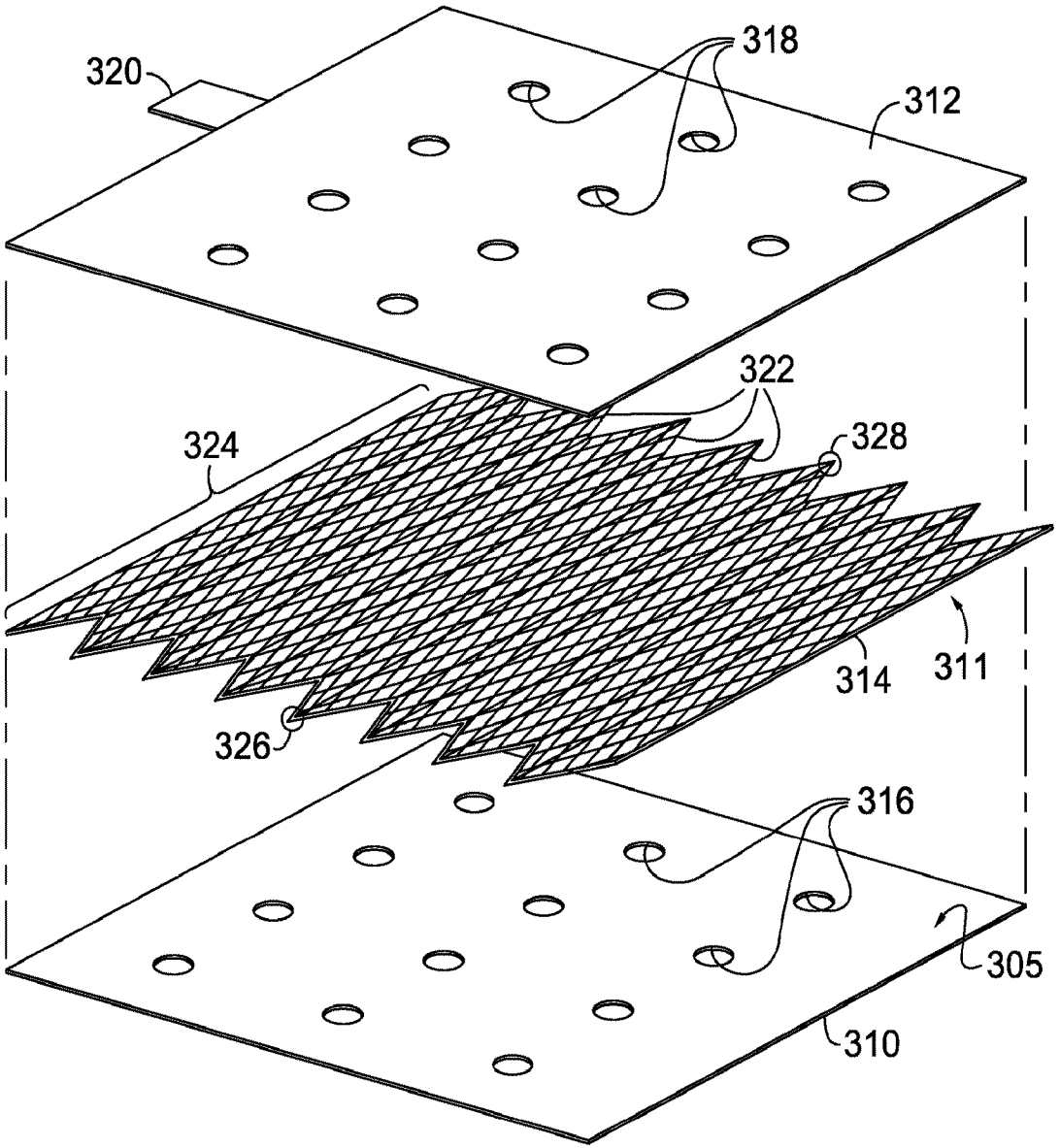
FIG. 3 illustrates an exploded view of another example apparel layer system in accordance with aspects herein.

Turning now to FIG. 3, an exploded view of an apparel layer system, such as the apparel layer system 100, is provided in accordance with aspects herein and is referenced generally by the numeral 300. The apparel layer system 300, in example aspects, may be configured to provide variable levels of air permeability. The apparel layer system 300 comprises a first layer of material 310 extending in a first planar direction, a second layer of material 312 extending in the first planar direction, and a third layer of material 314 positioned between or interposed between the first layer of material 310 and the second layer of material 312. To help provide air permeability, the first layer of material 310 may comprise, for example, a knit, woven, or non-woven material with a first set of perforations or apertures 316 formed at predetermined locations on the first layer of material 310. And the second layer of material 212 may also comprise a knit, woven, or non-woven material with a second set of perforations or apertures 318 formed at predetermined locations on the second layer of material 312. The apparel layer system 300 further comprises an adjustment mechanism 320 coupled to the second layer of material 312. The first and second sets of apertures 316/318 may be engineered through a mechanical process such as die cutting, laser cutting, water jet cutting, and the like, or the first and second sets of apertures 316/318 may be formed by modifying the knitting or weaving process used to form the respective layers of material 310 and 312. Any and all aspects, and any variation thereof, are contemplated as being within aspects herein.

With respect to the third layer of material 314, in one example aspect the third layer of material 314 may comprise a mesh material (shown in FIG. 3) to facilitate the flow of air through the different layers of material 310, 312, and 314. However, it is contemplated herein that the third layer of material 314 may comprise a different construction such as a knit material, a loosely woven material, or a material having engineered apertures. The third layer of material 314 comprises a series of folds 322 with each fold 322 having a long axis 324. The long axes 324 of the folds 322 are arranged in parallel to each other. Further, each fold 322 comprises a first apex region 326 and a second apex region 328 opposite the first apex region 326. In example aspects, the adjustment mechanism 320 is positioned on the second layer of material 312 such that it is configured to exert a tension force that is perpendicular to the long axes 324 of the folds 322. As described above, the first apex regions 326 may be selectively affixed to the first layer of material 310, and the second apex regions 328 of the folds 322 may be selectively affixed to the second layer of material 312.

In an alternative aspect, and when the apparel layer system 300 is used to provide warming and permeability, the third layer of material 314 may comprise a material having a reflective deposit on at least its first surface 311, where the first surface 311 is configured to be positioned adjacent to a first surface 305 of the first layer of material 310. The reflective deposit may comprise an aluminum-based material, a copper-based material, another metal or metal alloy-based material, or non-metal materials such as metallic plastic, or other man-made materials.

When the apparel layer system 300 is assembled, it assumes a structure similar to the apparel layer system 100 of FIGS. 1A-1C. As such, when the apparel layer system 300 is in a first state, such as the first state shown in FIG. 1A, the folds 322 extend generally in the first planar direction and, more specifically, the second apex regions 328 may extend in the positive x-direction, the first apex regions 326 may extend in the negative x-direction, and an angle, e, between a fold 322 and, for instance, the second layer of material 312 may be less than, for example, 10 degrees. Because the folds 322 generally lie flat in the first state, there is a small amount of vertical offset (offset in the z-direction) between the first and second layers of material 310/312. Further, because the folds 322 generally lie flat in the first state, a greater percentage of the surface area of the first surface 311 of the third layer of material 314 may be positioned adjacent to the first surface 305 of the first layer of material 310 as compared to when the apparel layer system is in the second state or third state.

The first and second set of apertures 316/318 may be positioned on the first and second layers of material 310/312 respectively such that when the apparel layer system 300 is in the first state, the first set of apertures 316 are not aligned with the second set of apertures 318 such that there is not a direct communication path between the first layer of material 310 and the second layer of material 312. To describe it a different way, when the apparel layer system 300 is in the first state, the first set of apertures 316 are laterally offset from the second set of apertures 318 such that there is little to no overlap between the apertures 316/318 (e.g., less than, for instance, 10% overlap between the apertures 316/318).

Figure 4:
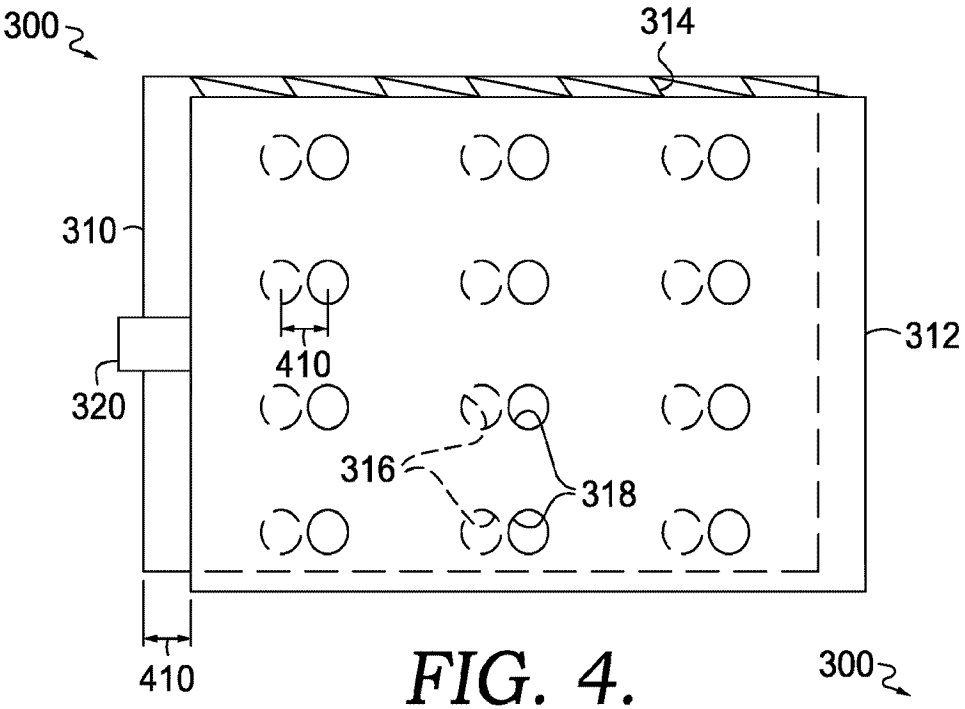
FIG. 4 illustrates a top view of the example apparel layer system of FIG. 3 in an as-assembled arrangement and in a first state in accordance with aspects herein.

This is depicted more clearly in FIG. 4 which depicts a top view of the apparel layer system 300 when the apparel layer system 300 is in the first state. As shown, the second layer of material 312 is offset from the first layer of material 310 in the first planar direction by a first amount of offset 410. Further, the apertures 318 of the second layer of material 312 are offset from the apertures 316 in the first layer of material 310 by the first amount 410 (as measured from the center of each aperture 316/318).

As shown in FIG. 4, the apertures 316 and the apertures 318 are not aligned with each other. To describe it a different way, the apertures 316 and 318 are offset from each other in at least the x-direction such that there is little if any overlap between the apertures 316 and 318 (e.g., less than, for example, 10% overlap). Thus, in the first state, there is generally not a direct communication path between the first layer of material 310 and the second layer of material 312 which helps to inhibit air flow through the two layers 310/312.

When the third layer of material 314 optionally comprises a reflective deposit on its first surface 311, radiant warming may be provided when the apparel layer system 300 is in the first state. For instance, in the first state, the folds 322 extend generally in the first planar direction (i.e., they lie flat) causing the reflective first surface 314 to be in a generally planar relationship with a body surface of a wearer when the apparel layer system 300 is incorporated into a garment or apparel item. Radiant heat energy produced by the wearer would be reflected back to the wearer's body surface via the reflective first surface 311 of the third layer of material 314 thereby helping to warm the wearer when at rest.

Returning generally to FIG. 3, to cause the apparel layer system 300 to provide a higher level of permeability, the adjustment mechanism 320 may be tensioned in, for example, the negative x-direction thereby causing the second apex regions 328 to also move in the negative x-direction due to the selective attachment of the second apex regions 328 to the second layer of material 312 while the first apex regions 326 generally remain stationary (e.g., they do not move in the negative x-direction or the positive x-direction). In example aspects, the movement of the adjustment mechanism 320 may cause the apparel layer system 300 to transition to the second state or the third state as shown in FIG. 1B and FIG. 1C respectively. As described, in the second state (or third state) the amount of offset in the first planar direction between the first layer of material 310 and the second layer of material 312 is reduced. The reduction in offset in the first planar direction causes the second set of apertures 318 to become at least partially vertically aligned (aligned in the z-direction) with the first set of apertures 316. Further, because the folds 322 generally stand partially upright or upright in the second or third state, a smaller percentage of the surface area of the first surface 311 of the third layer of material 314 may be positioned adjacent to the first surface 305 of the first layer of material 310 as compared to when the apparel layer system 300 is in the first state.

Figure 5:
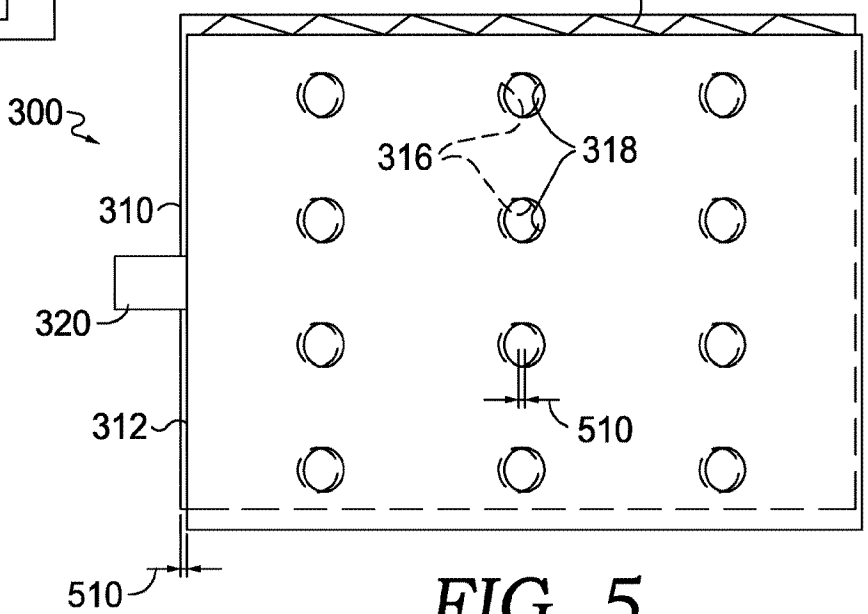
FIG. 5 illustrates a top view of the example apparel layer system of FIG. 3 in an as-assembled arrangement and in a second state in accordance with aspects herein.

This is depicted more clearly in FIG. 5 which depicts a top view of the apparel layer system 300 when the apparel layer system 300 is in, for instance, the third state as shown in FIG. 1C. As shown in FIG. 5, the second layer of material 312 is offset from the first layer of material 310 in the first planar direction by a second amount 510. Further, the apertures 318 of the second layer of material 312 are offset from the apertures 316 in the first layer of material 310 in the first planar direction by the second amount 510 (as measured from the center of each aperture 316/318). In example aspects, the second amount of offset 510 in the first planar direction is less than the first amount of offset 410 causing the apertures 316/318 to become aligned or at least partially aligned in the x-direction and the z-direction. To describe it a different way, there is a greater percentage of overlap between the apertures 316/318 in the third state (e.g., greater than, for instance, 90% overlap). Thus, in the third state, there is generally a direct communication path between the first layer of material 310 and the second layer of material 312 such that air may flow through the different layers 310/312. Further, as explained above, in some example aspects, the third layer of material 314 may be formed of a mesh material to facilitate the flow of air between the different layers 310/312/314. As mentioned earlier, it is contemplated herein that additional states between the first state and the third state may be achieved so that a customizable level of air permeability may be provided.

When the apparel layer system 300 is further used to provide radiant warming in addition to permeability (i.e., when the first surface 311 of the third layer of material 314 comprises a reflective deposit), transitioning the apparel layer system 300 to the second or third state causes a smaller percentage of the surface area of the first surface 311 of the third layer of material 314 to be exposed or oriented to the body surface of a wearer. This is because the folds 322 stand generally upright in the second and third states. In other words, in the second or third state, the third layer of material 314 no longer extends in the first planar direction. Because there is a smaller percentage of the reflective first surface 311 exposed or oriented to the body surface of the wearer, less radiant heat is reflected back to the wearer.

Figure 6:
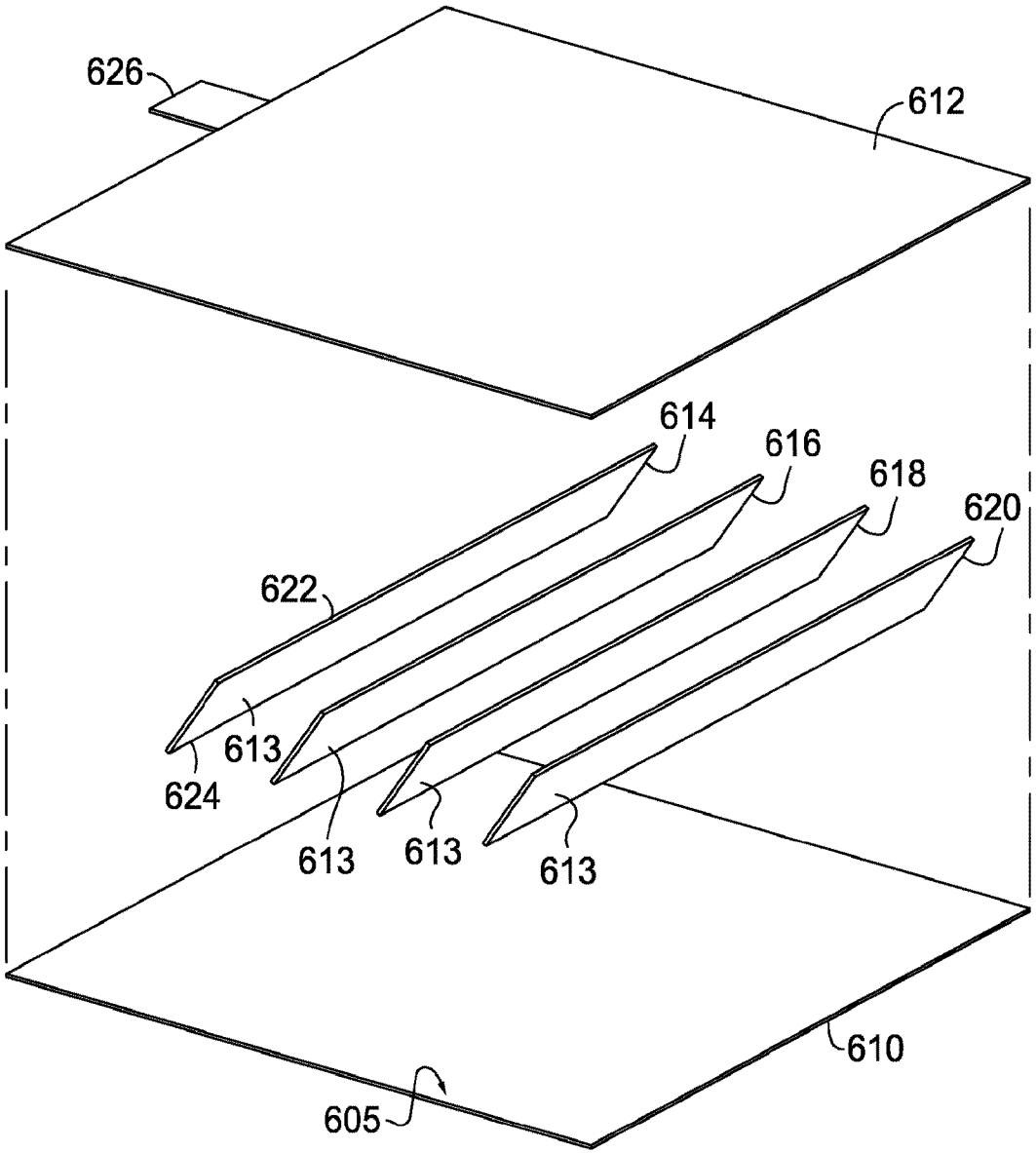
FIG. 6 illustrates an exploded view of an alternative configuration for an example apparel layer system in accordance with aspects herein.
Figure 7A:
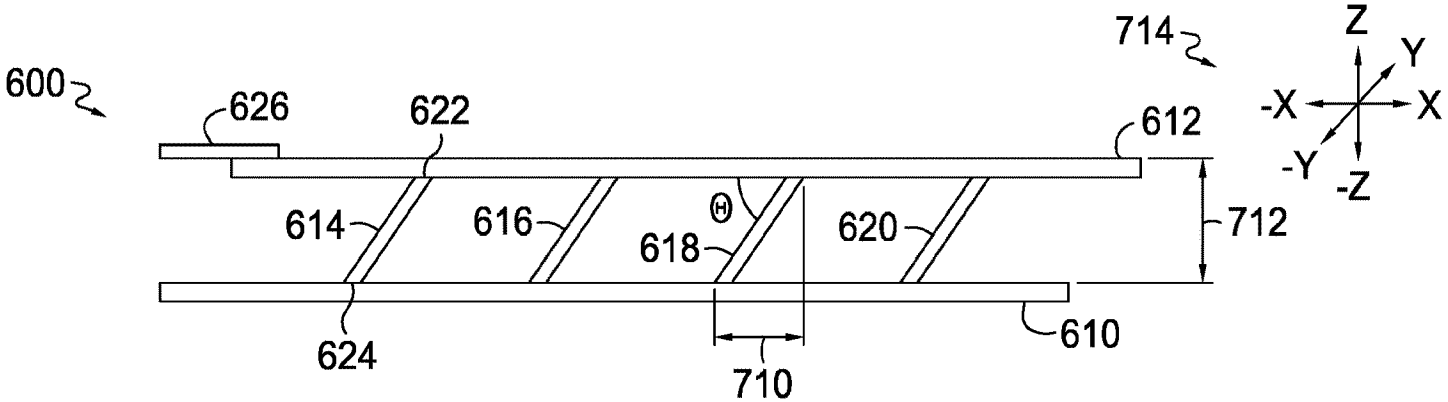
FIG. 7A illustrates a side view of the example apparel layer system of FIG. 6 in a first state in accordance with aspects herein.
Figure 7B:
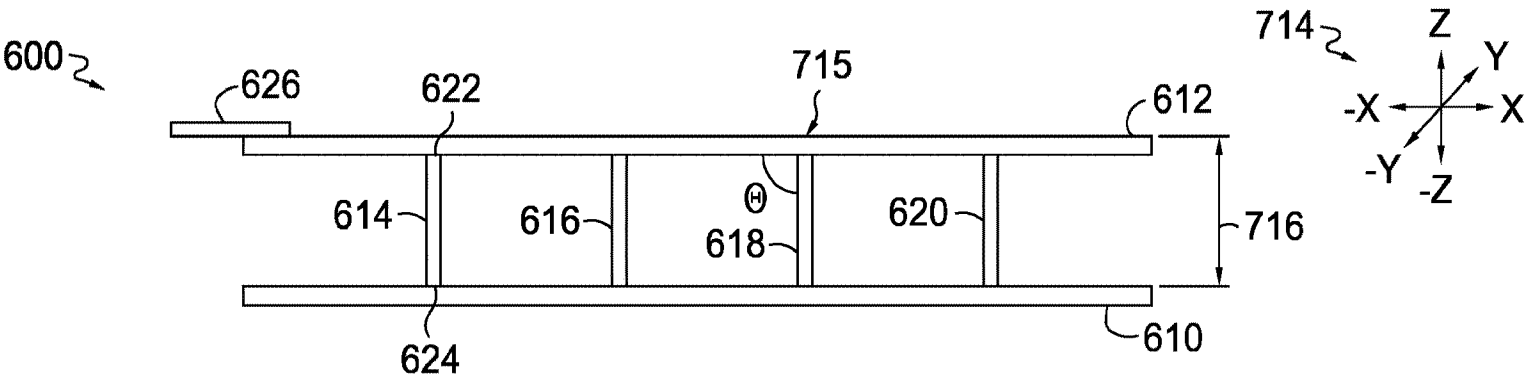
FIG. 7B illustrates a side view of the example apparel layer system of FIG. 6 in a second state in accordance with aspects herein.

An alternative configuration for an apparel layer system in accordance with aspects herein is provided in FIG. 6 and FIGS. 7A-7B. FIG. 6 depicts an exploded view of an apparel layer system 600 comprising a first layer of material 610 and a second layer of material 612. Instead of a third layer of material formed into a series of folds, the apparel layer system 600 comprises a plurality of discrete panels 614, 616, 618, and 620. Each of the panels 614, 616, 618, and 620 is defined by at least a first longitudinal edge 622 and a second longitudinal edge 624 (shown for panel 614) opposite the first longitudinal edge 622. When assembled, each panel's respective first edge 622 is affixed to the second layer of material 612 along at least a portion of the length of the first edge 622 by, for instance, stitching, bonding, welding, adhesives, and the like. Further, each panel's respective second edge 624 is affixed to the first layer of material 610 along at least a portion of the length of the second edge 624.

Depending on if the apparel layer system 600 is configured to provide variable levels of permeability, apertures may be provided in the first and second layers of material 610 and 612. Further, apertures may also be provided in some or all of the panels 614, 616, 618, and 620, or the panels 614, 616, 618, and 620 may be formed from a mesh material to facilitate air flow between the layers 610/612. If the apparel layer system 600 is configured to provide warming, the panels 614, 616, 618, and 620 may have a reflective material deposited on at least a surface 613, where the surface 613 is configured to be positioned adjacent to a surface 605 of the first layer of material 610. Apertures may be absent when the apparel layer system 600 is used for insulation.

Side views of the apparel layer system 600 are provided in FIGS. 7A and 7B where FIG. 7A illustrates the apparel layer system 600 in a first state, and FIG. 7B illustrates the apparel layer system 600 in a second state. With respect to FIG. 7A, the first layer of material 610 extends in a first planar direction (e.g., in an x, y reference plane) as indicated by Cartesian coordinate system 714. Similarly, the second layer of material 612 also extends in the first planar direction and is parallel to and offset from the first layer of material 610. The panels 614, 616, 618, and 620 (shown from the side in FIGS. 7A and 7B) are positioned between the first and second layers of material 610/612. Each panel's respective first edge 622 is affixed to an inner surface of the second layer of material 612, and each panel's respective second edge 624 is affixed to the surface 605 of the first layer of material 610.

In the first state, and as shown in FIG. 7A, the first layer of material 610 is offset in the first planar direction from the second layer of material 612 by a first amount 710. More particularly, with respect to a particular panel such as the panel 618, the first edge 622 is offset in the first planar direction from the second edge 624 by the first amount 710. Further, in the first state, the second layer of material 612 is offset in a second direction perpendicular to the first planar direction (i.e., in a positive z-direction) by a first amount 712. It is contemplated herein, that in the first state, the panels 614, 616, 618, and 620 generally lie flat such that the panels 614, 616, 618, and 620 extend in, for instance, the positive x-direction. For clarity, the panels 614, 616, 618, and 620 in FIG. 7A are not shown lying completely flat. More particularly, each panel's respective first edge 622 extends in the positive x-direction, and each panel's respective second edge 624 extends in the negative x-direction. Further, in the first state, an angle, e, formed between a respective panels, such as the panel 618, and the second layer of material 612 may be less than, for example, 10 degrees.

Similar to the apparel layer system 100, the apparel layer system 600 can be transitioned to the second state by exerting a tensioning force on the adjustment mechanism 626 in the negative x-direction. This causes the second layer of material 612 to move relative to the first layer of material 610. And due to the selective attachment of each panel's respective first edges 622 to the second layer of material 612, and due to the selective attachment of each panel's respective second edges 624 to the first layer of material 610, movement of the second layer of material 612 causes a corresponding movement of the first edges 622 of the panels 614, 616, 618, and 620 in the negative x-direction. The second edges 624 generally remain stationary and function as anchor points.

In the second state, the first layer of material 610 is offset in the first planar direction from the second layer of material 612 by a second amount 715 which is less than the first amount 710. More particularly, and again with respect to the panel 618, the first edge 622 is offset in the first planar direction for the second edge 624 by the second amount 715. In example aspects, the second amount of offset 715 between, for instance, the first edge 622 and the second edge 624 of a particular panel may be zero or near zero. Further, in the second state, the second layer of material 612 is offset in the second direction perpendicular to the first planar direction (i.e., in a positive z-direction) by a second amount 716 that is greater than the first amount 712. It is contemplated herein, that in the second state, the panels 614, 616, 618, and 620 generally are positioned upright such that the panels 614, 616, 618, and 620 extend in, for instance, the second direction (e.g., the z-direction). Further, in the second state, the angle, e, formed between a respective panel, such as the panel 618, and the second layer of material 612 may be greater than, for example, 10 degrees, and/or may be between 75 degrees and 90 degrees. When the angle, e, is 90 degrees, a maximum amount of offset in the second direction (the positive z-direction) is achieved. Thus, as seen, although the apparel layer system 600 utilizes separate panels instead of a folded, unitary material as in the apparel layer system 100, the apparel layer system 600 functions in much that same way to provide variable levels of insulation, warming, or permeability.

Figure 8A:
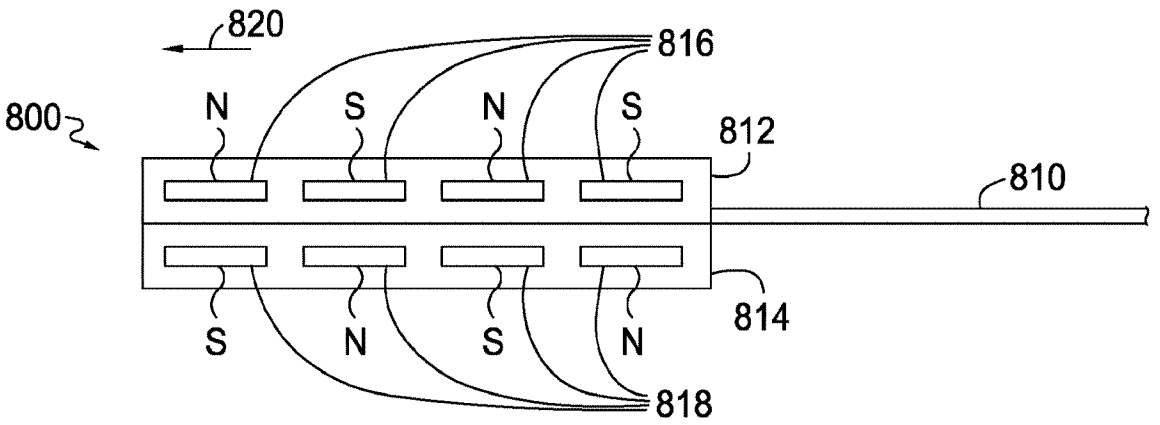
FIGS. 8A-8C illustrate an example adjustment mechanism for use with an apparel layer system in accordance with aspects herein.
Figure 8B:
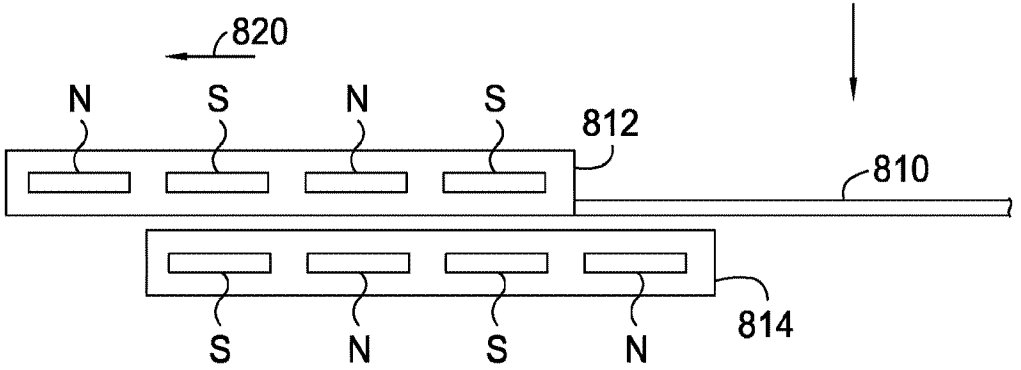
Figure 8C:
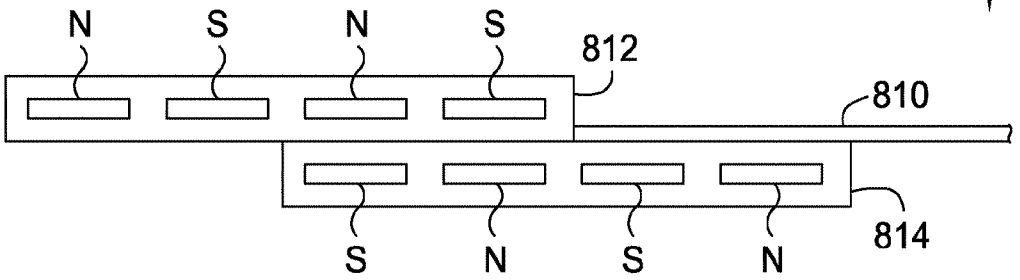

With respect to the adjustment mechanism that is coupled to the second layer of material, aspects herein contemplate a number of different mechanisms such as pull tabs and/or slider assemblies. One example mechanism 800 that utilizes strips or tapes of material having alternating and repeating magnetic elements (commonly known as multi-pole magnet strips) is depicted in FIGS. 8A-8C in accordance with aspects herein. The mechanism 800 comprises a first textile material 810 to which a first magnetic strip 812 is affixed. The first textile material 810 may correspond to the second layer of material 112. In the aspect depicted in FIGS. 8A-8C, the first magnetic strip 812 comprises a magnetic tape having first and second magnetic elements (i.e., North and South poles) 816 arranged in an alternating and repeating pattern. In example aspects, the first magnetic strip 812 may be covered by a textile for a cleaner aesthetic and a better hand feel. Further, a reinforced portion may be located at one end of the textile (e.g., the end opposite that affixed to the first textile material 810) for easy grasping by a wearer.

The mechanism 800 further comprises a second magnetic strip 814 having first and second magnetic elements (i.e., North and South poles) 818 arranged in an alternating and repeating pattern. The second magnetic strip 814 may be affixed to a second textile material (not shown). The second textile material may comprise part of a garment to which an apparel layer system is incorporated and/or may comprise a first layer of material of an apparel layer system such as the first layer of material 110 of FIGS. 1A-1C. It is contemplated herein, that the second magnetic strip 814 is configured to be maintained in a relatively fixed position.

FIG. 8A depicts the first magnetic strip 812 and the second magnetic strip 814 held in contact with each other due to the attraction force between magnetic elements 816 and magnetic elements 818 having opposite polarity. To describe it differently, the first magnetic strip 812 is in contact with the second magnetic strip 814 due to the vertical alignment (alignment in the z-direction) of magnetic elements having opposite polarity. The positioning of the first and second magnetic strips 812/814 in FIG. 8A may correspond to, for example, a first state of an apparel layer system such as the first state shown in FIG. 1A for the apparel layer system 100. Movement (e.g., lateral movement) of the first magnetic strip 812 relative to the second magnetic strip 814 may be initiated by a mechanical pulling force 820 (e.g., a wearer's fingers) on the first magnetic strip

812, where the pulling force 820 has sufficient magnitude to overcome the attraction force between the magnetic elements 816 located on the first magnetic strip 812 and the magnetic elements 818 located on the second magnetic strip 814.

As shown in FIG. 8B, once the mechanical pulling force 820 is initiated, the movement of the first magnetic strip 812 is constrained by the second magnetic strip 814 such that the two strips 812/814 are maintained in a close but spaced-apart relationship. For instance, as shown in FIG. 8B, the repulsion force between magnetic elements 816 and magnetic elements 818 having the same polarity causes the strips 812/814 to repulse each other so that the strips 812/814 remain disengaged. But the attraction force between magnetic elements 816 and magnetic elements 818 having opposite polarity helps to keep the strips 812/814 in a close, spaced-apart relationship to each other (i.e., they do not become completely disengaged such that a wearer would need to re-engage the strips 812/814 with each other). To describe this in a different way, the first magnetic strip 812 is disengaged from the second magnetic strip 814 when magnetic elements having the same polarity are in vertical alignment (i.e., aligned in the z-direction).

Because the strips 812/814 comprise alternate and repeating magnetic elements, the first magnetic strip 812 is able to slidably move relative to the second magnetic strip 814 in discrete, incremental steps. Stated differently, the slidable movement of the first magnetic strip 812 relative to the second magnetic strip 814 is guided by the alternating and repeating magnetic elements 816/818 of the strips 812/814. Once a desired shift of the first textile material 810 is achieved, the first magnetic strip 812 can be "locked in place" or made to contact the second magnetic strip 814 by allowing the magnetic elements 816 of the first magnetic strip to engage with the magnetic elements 818 of the second magnetic strip 814 that have opposite polarity. This occurs, as described above, when the magnetic elements having opposite polarity are in vertical alignment with each other. This aspect is shown in FIG. 8C and may correspond to, for instance, the second state shown in the FIG. 1B for the apparel layer system 100 or the third state shown in FIG. 1C.

The use of this configuration enables the first textile material 810 to be shifted in incremental steps in relation to, for example, the first layer of an apparel layer system. In turn, this allows for the fine-tuning of insulation, warming, or permeability levels of a garment incorporating the apparel layer system described herein. Although four magnetic elements are depicted for each strip 812/814, it is contemplated herein that the strips 812/814 may comprise a fewer or greater number of magnetic elements. Any and all aspects, and any variation thereof, are contemplated as being within aspects herein.

Although the mechanism 800 is shown as comprising magnetic strips having alternating and repeating magnetic elements, a somewhat similar function may be achieved by using complementary tapes having, for example, a stud on one of the tapes and repeating sockets on the complementary tape (or vice versa), a button on one of the tapes and repeating button holes on the complementary tape (or vice versa), hooks on one of the tapes and loops on the complementary tape (e.g., a hook-and-loop fastener system), and the like. The functional effect produced by these different mechanisms would be similar to the use of the magnetic strips in that an incremental adjustment of a second layer of material relative to a first layer of material may be achieved.

Figure 9A:
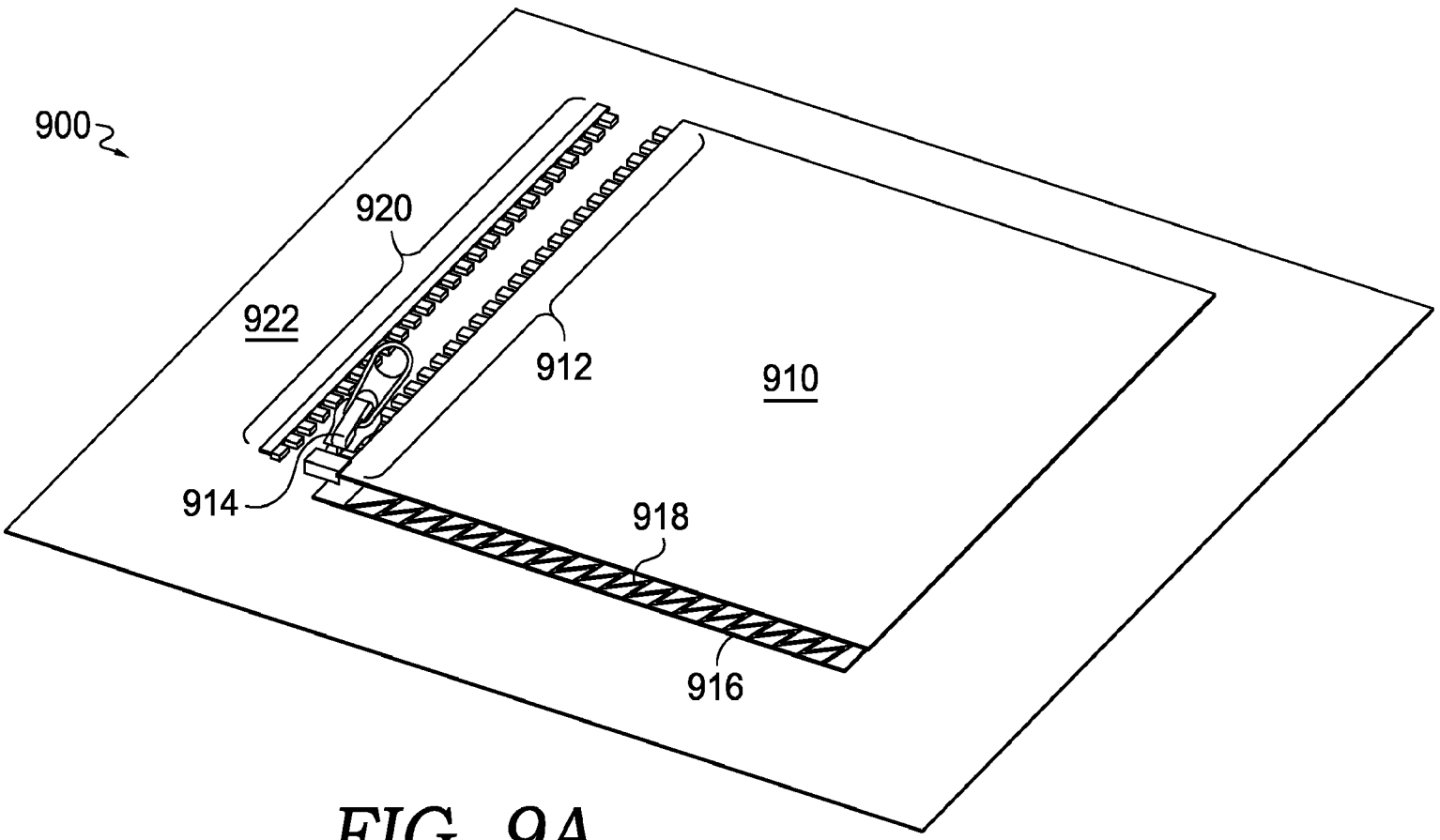
FIGS. 9A-9B illustrate another example adjustment mechanism for use with an apparel layer system in accordance with aspects herein.
Figure 9B:
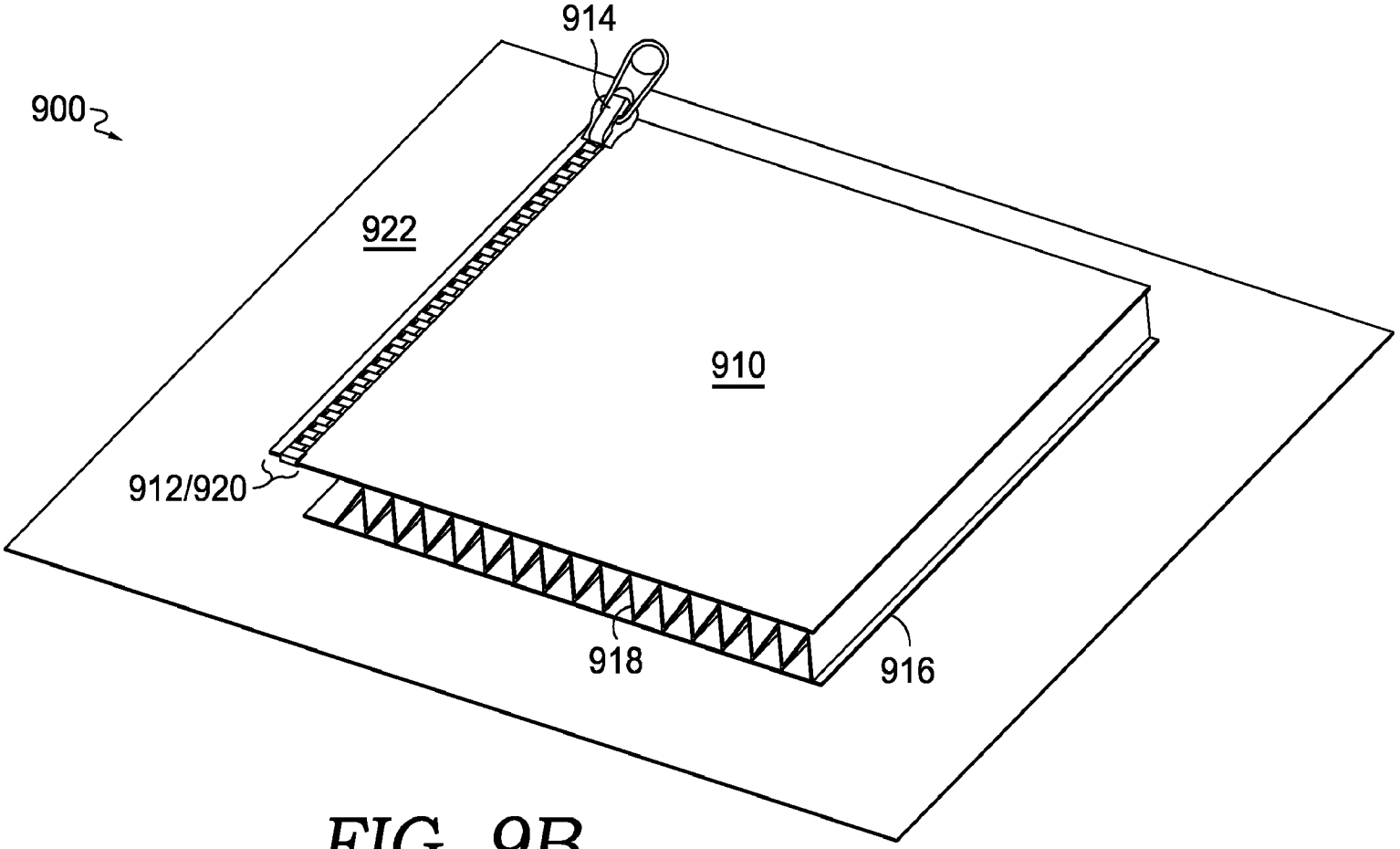

A different type of adjustment mechanism is shown in FIGS. 9A and 9B and is referenced generally by the numeral 900. With respect to FIG. 9A, a second layer of material 910, such as the second layer of material 112 of FIGS. 1A-1C, is shown having a first set of slider elements 912 (for example, zipper teeth) attached to a perimeter edge of the second layer of material 910. This may occur by affixing the first set of slider elements 912 to the second layer of material 910 using a tape or by directly affixing the slider elements 912 to the second layer of material 910. A slider pull 914 is also shown coupled to the first set of slider elements 912. The second layer of material 910 may be part of an apparel layer system further comprising a first layer of material 916 and a third layer of material 918 formed into a series of folds as described in relation to FIGS. 1A-1C and as shown in FIG. 9A or a plurality of separate panels as described in relation to FIG. 6 and FIGS. 7A-7B.

The adjustment mechanism 900 further comprises a second set of slider elements 920 affixed to a garment panel 922 (in example aspects, the first layer of material 916 may also comprise the garment panel 922). The second set of slider elements 920 are positioned to be in parallel alignment with the first set of slider elements 912 and may be affixed to the garment panel 922 via a tape or by directly affixing the slider elements 912 to the garment panel 922. FIG. 9A depicts the second layer of material 910 in a first position relative to the first layer of material 916. This may be similar to the first state shown in FIG. 1A for the apparel layer system 100 or the first state shown in FIG. 7A for the apparel layer system 600.

FIG. 9B depicts the second layer of material 910 in a second position relative to the first layer of material 916. This may correspond to, for example, the second state or the third state shown in FIGS. 1A and 1B respectively for the apparel layer system 100 or the second state or third state shown in FIG. 7B for the apparel layer system 600. To transition the second layer of material 910 to the second position, the first set of slider elements 912 may be engaged with the second set of slider elements 920 using, for instance, the slider pull 914. Because the second set of slider elements 920 are coupled to the stationary garment panel 922, the second layer of material 910 is shifted toward the second set of slider elements 920 in order to engage the slider elements 912/920. As described above for the apparel layer system 100, the shift of the second layer of material 910 causes the folds of the third layer of material 918 to become more upright causing a greater offset in the z-direction between the first layer of material 916 and the second layer of material 910. A similar result occurs when the third layer of material is in the form of discrete panels.

Figure 14A:
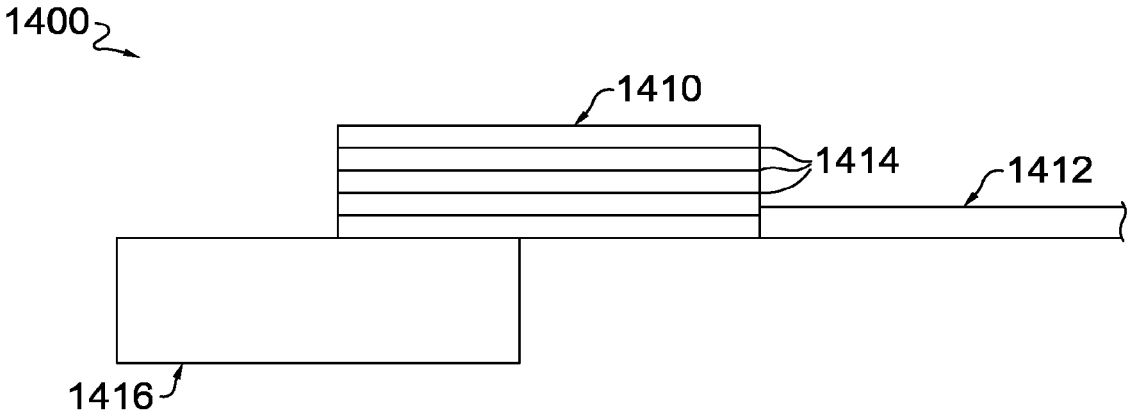
FIGS. 14A-14B illustrate an example adjustment mechanism for use with an apparel layer system in accordance with aspects herein.
Figure 14B:
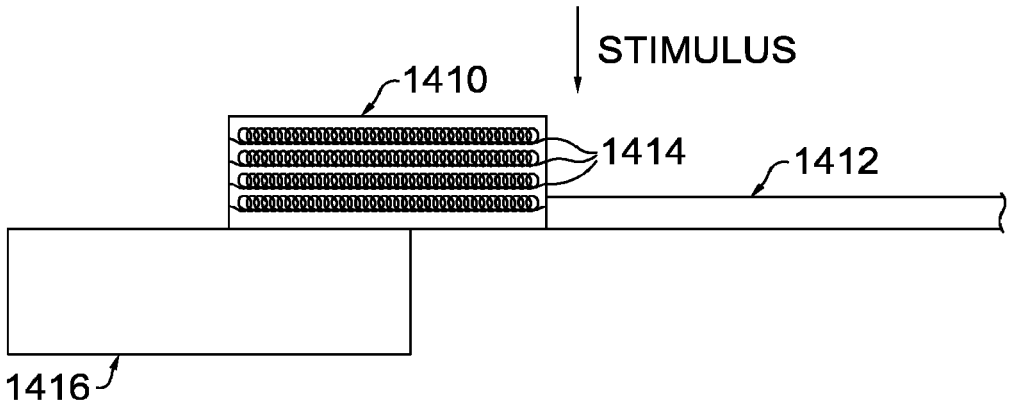

FIGS. 14A and 14B depict yet another adjustment mechanism 1400 in accordance with aspects herein. With respect to FIG. 14A, this figure depicts the adjustment mechanism 1400 in a first state. The adjustment mechanism 1400 comprises a first portion 1410 coupled to a layer of material 1412 such as, for example, the second layer of material 112 of the apparel layer system 100 (additional layers of the apparel layer system are not shown). In example aspects, the first portion 1410 may be a knit or woven structure formed from yarns 1414 that dimensionally transform upon exposure to a stimulus such as moisture. For example, the yarns 1414 may comprise a bi-component yarn formed from polyester and nylon that crimps or curls when exposed to the stimulus. The yarns 1414 are oriented in the first portion 1410 such that their long axes are perpendicular to, for example, the long axes of the folds (or panels) formed from a third layer of material of an apparel layer system (i.e., the third layer of material 114 of the apparel layer system 100).

Continuing, the first portion 1410 of the adjustment mechanism 1400 may be fixedly attached to a second portion 1416. The second portion 1416 may be affixed to a second textile material (not shown). The second textile material may comprise part of a garment to which an apparel layer system is incorporated and/or may comprise a first layer of material of an apparel layer system such as the first layer of material 110 of FIGS. 1A-1C. It is contemplated herein, that the second portion 1416 is configured to be maintained in a relatively fixed position.

FIG. 14B illustrates the adjustment mechanism 1400 after exposure to a stimulus. The stimulus may comprise water or other types of moisture, light, magnetic fields, a change in temperature, and the like. Upon exposure to the stimulus, the yarns 1414 may crimp or curl causing the first portion 1410 to shorten in length. In other words, the stimulus may cause the yarns 1414 to undergo a dimensional transformation where the dimensional transformation is a shortening in the length of the yarns 1414. Because the first portion 1410 is fixedly secured to the layer of material 1412, a shortening of the first portion 1410 causes the layer of material 1412 to shift toward the second portion 1416. As described above for the apparel layer system 100, the shift of the layer of material 1412 in the negative x-direction causes the folds of the third layer of material to become more upright causing a greater offset in the z-direction between the layer of material 1412 and a first layer of material (not shown). A similar result occurs when the third layer of material is in the form of discrete panels. It is contemplated herein that instead of just a single first portion 1410 there may be multiple first portions each affixed to the layer of material 1412 as shown and formed from the yarns 1414 Additional adjustment mechanisms beyond those shown and described are contemplated as being within aspects herein. Any adjustment mechanism that causes, upon mechanical manipulation of the adjustment mechanism, a shifting of a second textile layer relative to a first textile layer is contemplated as being within aspects herein.

Figure 10:
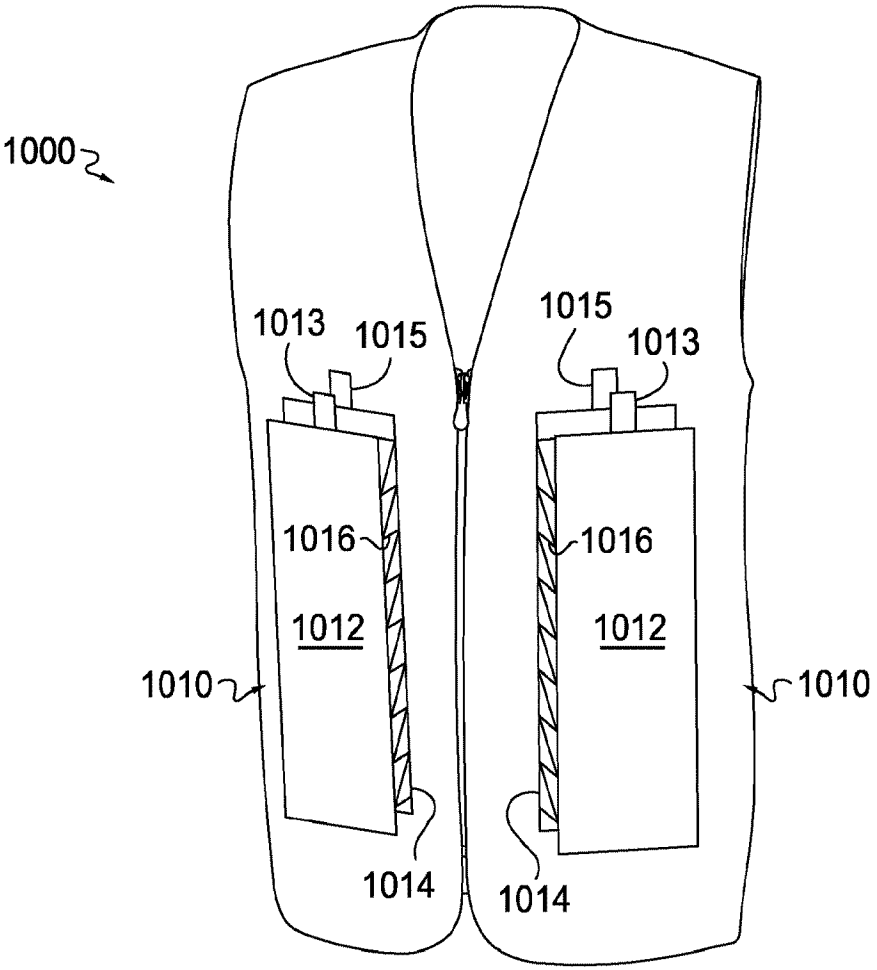
FIG. 10 illustrates an upper-body garment incorporating an example apparel layer system in accordance with aspects herein.

FIG. 10 depicts a front perspective view of an apparel layer system incorporated into a garment in accordance with aspects herein. The apparel layer system is indicated by reference numeral 1010, and the garment is indicated by reference numeral 1000. The garment 1000 is shown as an upper body garment and is further shown as a vest-type structure without sleeves. Although shown as a vest without sleeves, it is contemplated herein that the garment 1000 may comprise other types of upper body garments such as a pullover, a hoodie, a long-sleeve short, a short-sleeved shirt, and the like. The garment 1000 may also comprise a support garment such as a bra. It is also contemplated herein that the apparel layer system 1010 may be incorporated into apparel items and equipment meant to be worn by a wearer such as, for example, hats, socks, shin guards, compression sleeves, pads, and the like. Any and all aspects, and any variation thereof, are contemplated as being within aspects herein.

The apparel layer system 1010 is shown as being positioned on a front right aspect of the garment 1000 and on a front left aspect of the garment 1000. These locations are illustrative only, and it is contemplated herein that the apparel layer system 1010 may be positioned on the garment 1000 in other locations based on the function of the apparel layer system 1010. For instance, when the apparel layer system 1010 is configured to provide variable levels of air permeability, such as the apparel layer system 300, the apparel layer system 1010 may be positioned on the garment 1000 such that it is configured to be adjacent to high heat or sweat producing areas of the wearer when the garment 1000 is worn. Example locations may comprise, for example, an upper center back area, a lower center back area, and an upper front chest area. When the apparel layer system 1010 is configured to provide variable levels of insulation and/or radiant warming, such as the apparel layer system 200, the apparel layer system 1010 may be positioned on the garment 1000 such that it is configured to be adjacent to low heat producing, or high heat loss areas of the wearer when the garment 1000 is worn such as, for example, a lower front chest area, a head area, an arm area, and the like. When the apparel layer system 1010 is configured to provide both permeability and radiant warming, the apparel layer system 1010 may be positioned adjacent to high heat and/or sweat producing areas with the thought that the warming function of the apparel layer system 1010 may be "turned off" once the wearer begins exercising.

With respect to the apparel layer system 1010, the apparel layer system 1010 may comprise a second layer of material 1012, an adjustment mechanism 1013 coupled to the second layer of material 1012, a first layer of material 1014, and a third layer of material 1016 positioned between the first layer of material 1014 and the second layer of material 1012. The second layer of material 1012 may comprise the second layer of material 112 of FIGS. 1A-1C and is shown as being positioned on an outer-facing surface of the garment 1000. That is, the second layer of material 1012, in example aspects, may be configured to face an external environment or one or more additional layers positioned external to the garment 1000. The first layer of material 1014 may comprise the first layer of material 110 of FIGS. 1A-1C and is shown as being positioned internal to the second layer of material 1012. As such, the first layer of material 1014 may be configured to face a body surface of a wearer when the garment 1000 is worn. As used herein, the term "body surface" may mean an actual skin surface of a wearer or it may mean one or more additional layers positioned internal to the first layer of material 1014. A second mechanism 1015, complementary to the adjustment mechanism 1013 is depicted as being coupled to the garment 1000 and/or to the first layer of material 1014.

It is contemplated herein that the apparel layer system 1010 may be incorporated into the garment 1000 as a panel or trim piece. That is, perimeter edges of at least the second layer of material 1012 and the first layer of material 1014 may be coupled to the garment 1000. In one example, a cut-out having the perimeter shape of the apparel layer system 1010 may be formed in the garment 1000, and the apparel layer system 1010 may be positioned within the cut-out and the perimeter edges of the apparel layer system 1010 may be affixed to the edges of the cut-out. In another implementation example, the apparel layer system 1010 may be positioned over the panel material of the garment 1000 and the perimeter edges of the apparel layer system 1010 may be affixed to the underlying panel material.

In yet another implementation example, the first layer of material 1014 may comprise an integral extension of the panel material forming the garment 1000. That is, instead of the first layer of material 1014 comprising a piece separate from the garment 1000, it may comprise the panel material forming the garment 1000. In this example, the third layer of material 1014 and the second layer of material 1012 would be affixed to the garment 1000 at a desired location to form the apparel layer system 1010. In yet another implementation example, the first layer of material 1014, the second layer of material 1012, and/or the third layer of material 1016 may all be integrally formed from the panel material forming the garment 1000. That is the panel material forming the garment 1000 may be created through a knitting or weaving process. The knitting or weaving process may be modified to, for instance, form at least the first layer of material 1014, the second layer of material 1012, and/or the third layer of material 1016. Any and all aspects, and any variation thereof, are contemplated as being within aspects herein.

Figure 11:
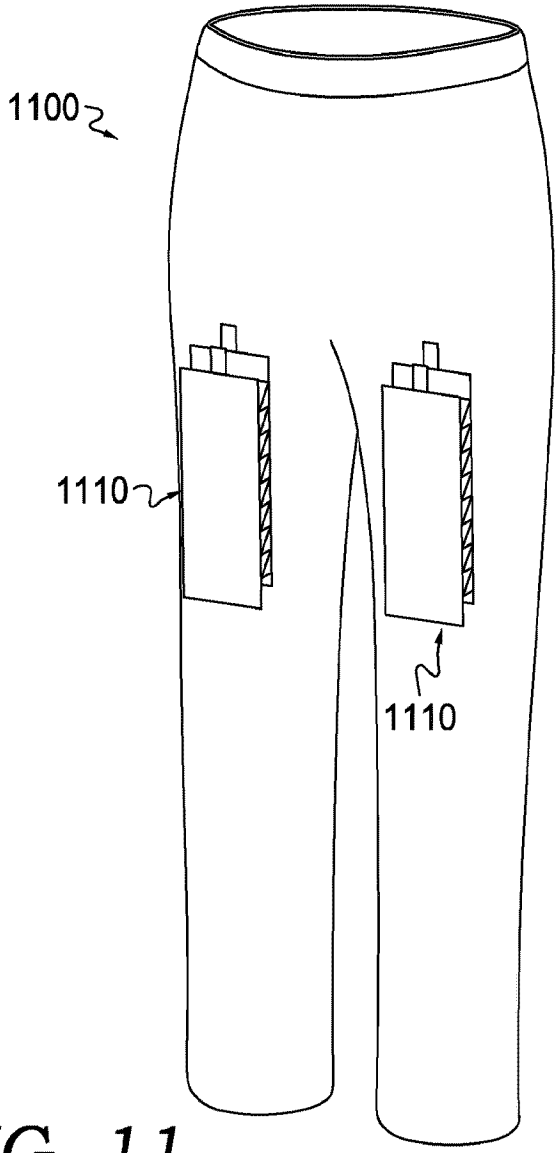
FIG. 11 illustrates a lower-body garment incorporating an example layer system in accordance with aspects herein.

FIG. 11 illustrates and apparel layer system incorporated into a lower-body garment in accordance with aspects herein. The lower-body garment is indicated by reference numeral 1100, and the apparel layer system is indicated by the reference numeral 1110. Many of the aspects of the apparel layer system 1010 such as construction details, implementation details, and placement based on insulation needs and permeability needs are applicable to the apparel layer system 1110 and, as such, will not be repeated for brevity sake. FIG. 11 is provided to illustrate that apparel layer systems may also be incorporated into lower-body garments. Although shown as a pair of long pants, it is contemplated herein that the garment 1100 may be in the form of a short, a capri, a legging, a tight, and the like.

The apparel layer system 1110 is shown positioned over a front, upper aspect of respective leg portions of the garment 1100. These areas correspond to the upper thigh area of a wearer when the garment 1100 is worn. As previously set forth, the apparel layer system 1110 may be configured to provide variable insulation levels, variable warming levels, or to provide variable air permeability levels. Although shown as being positioned at the front, upper aspect of the lower-body garment 1100, it is contemplated herein that the apparel layer system 1110 may also be positioned at other locations on the lower-body garment 1100 depending on where insulation, warming, or air permeability is desired. Any and all aspects, and any variation thereof, are contemplated as being within aspects herein.

Figure 12:
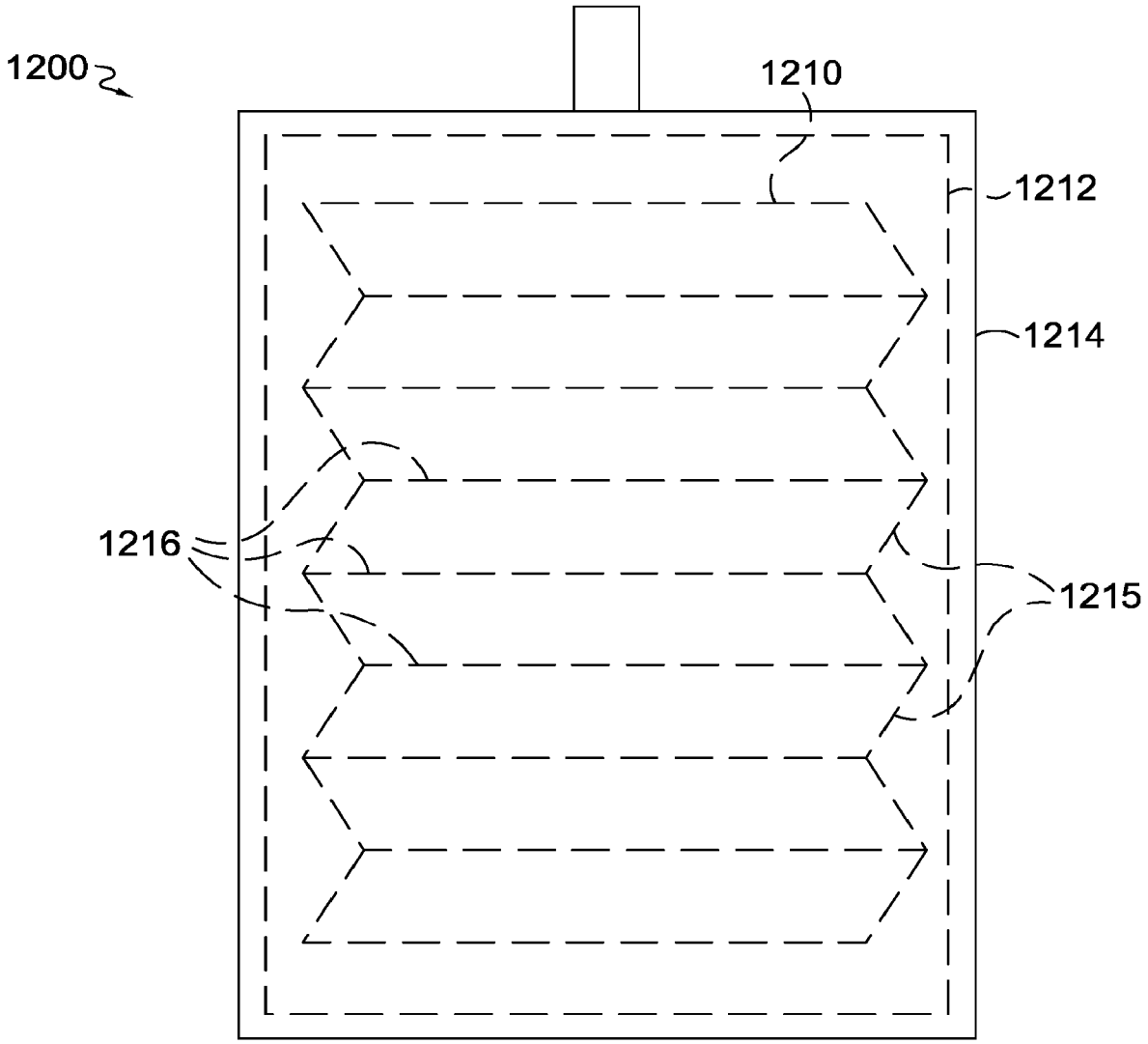
FIG. 12 illustrates an example construction method of forming an apparel layer system in accordance with aspects herein.

Turning now to FIG. 12, an apparel layer system 1200 is depicted in accordance with aspects herein. FIG. 12 is provided to illustrate one way of positioning the third layer of material (referenced here by the numeral 1210 and shown by dashed lines to indicate it is hidden from view) between a first layer of material 1212 (also shown by dashed lines to indicate it is hidden from view) and a second layer of material 1214 so that the ends 1215 of the folds 1216 of the third layer of material 1210 are not exposed. This may be advantageous when the apparel layer system 1200 is used to provide variable levels of the insulation. In this use case, it would not necessarily be desirable to have the ends 1215 of the third layer of material 1210 exposed because they would potentially act as egress points for warmed air to leave the apparel layer system 1200. To overcome this, the third layer of material 1210 may be sized smaller than the first layer of material 1212 and the second layer of material 1214. That is, the perimeter shape of the third layer of material 1210 may be smaller (e.g., less width and less length) than the first and second layers of material 1212/1214. The third layer of material 1210 is positioned between the first and second layers 1212/1214 such that the respective edges of the first and second layers of material 1212/1214 are affixed directly together. The result of this construction is a "sealed" space which may help to retain any warmed air in order to provide effective insulation. In an alternative construction where the first layer of material 1212 forms at least a portion of an underlying garment or apparel item, the respective edges of the second layer of material 1214 would be secured to the first layer of material 1212.

Figure 13:
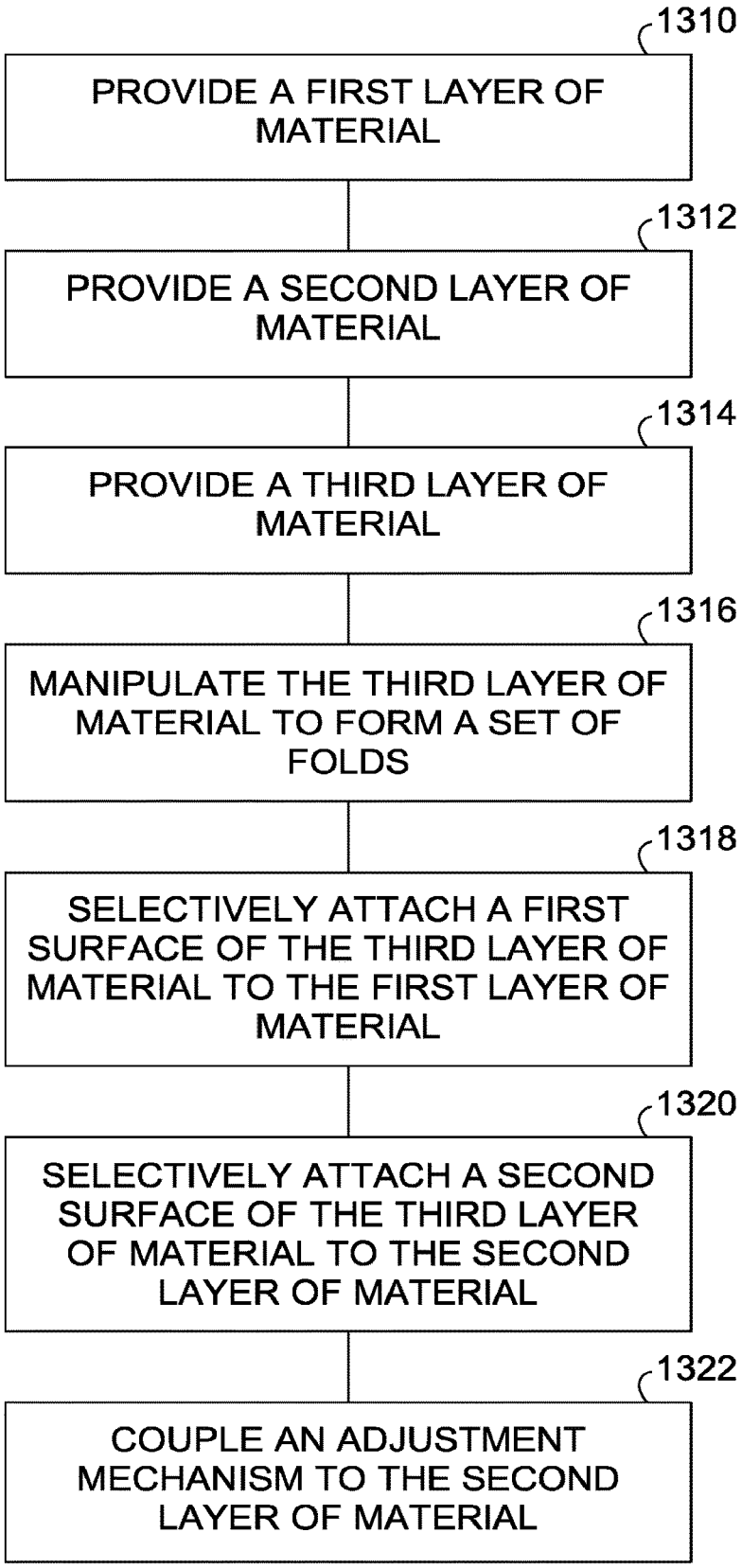
FIG. 13 illustrates a flow diagram of an example method of forming an apparel layer system in accordance with aspects herein.

FIG. 13 depicts a flow diagram of an example method 1300 for forming an apparel layer system in accordance with aspects herein. The apparel layer system may comprise, for example, the apparel layer system 100, 200, or 300. At a first step 1310, a first layer of material is provided. When the apparel layer system is intended to be used to provide variable levels of insulation and/or radiant warming, the first layer of material may comprise, for example, a tightly woven material or even a non-woven material such as a felt or other similar materials. When the first layer of material is intended to provide variable levels of air permeability and/or radiant warming, the first layer of material may comprise a knit material with or without apertures. For instance, when formed without engineered apertures, the knit material may comprise a loosely knit material. The material may also comprise a woven, or non-woven material having apertures. In example aspects, the first layer of material may also be used to form a garment or apparel item incorporating the apparel layer system.

At a step 1312, a second layer of material is provided. Similar to the first layer of material provided at the step 1310, when the apparel layer system is intended to be used to provide variable levels of insulation and/or warming, the second layer of material may comprise, for example, a tightly woven material or even a non-woven material such as a felt or other similar materials. When the second layer of material is intended to be used to provide variable levels of air permeability and/or radiant warming, the second layer of material may comprise a knit material with or without apertures. For instance, when formed without engineered apertures, the knit material may comprise a loosely knit material. The material may also comprise a woven, or non-woven material having apertures.

At a step 1314, a third layer of material is provided. When the apparel layer system is used to provide variable levels of insulation, the third layer of material may comprise a tightly woven material or a non-woven material such as felt or other similar materials. When the third layer of material is intended to provide variable levels of air permeability, the third layer of material may comprise a knit material, a mesh material, and/or a woven or non-woven material with apertures. And when the third layer of material is intended to provide variable levels of radiant warming, at least a first surface of the third layer of material may comprise a reflective surface. In this aspect, the reflective surface of the third layer of material is positioned adjacent to a first surface of the first layer of material. As described in relation to FIGS. 6, 7A, and 7B, it is also contemplated herein that the third layer of material may comprise a plurality of discrete panels. Any and all aspects, and any variation thereof, are contemplated as being within aspects herein.

When the third layer of material is provided as a unitary panel, at a step 1316, the third layer of material is manipulated to form a series of parallel folds. Each fold may comprise a first apex region and a second opposite apex region. At a step 1318, the third layer of material is selectively attached to the first layer of material. More specifically, the first apex regions of the folds of the third layer of material are affixed to a surface of the first layer of material using, for example, stitching, adhesives, welding, bonding, and the like. At a step 1320, the third layer of material is further selectively attached to the second layer of material. More specifically, the second apex regions of the folds of the third layer of material are affixed to a surface of the second layer of material using, for instance, stitching, adhesives, welding, bonding, and the like.

In an alternative aspect where the third layer of material is provided as a plurality of discrete panels, each panel may be defined by at least a first lengthwise edge and a second lengthwise edge. The first lengthwise edge of each of the panels is affixed to a surface of the first layer of material using one or more of the affixing technologies discussed in steps 1318 and 1320. Similarly, the second lengthwise edge of the each of the panels is affixed to a surface of the second layer of material using affixing technologies discussed herein.

At a step 1322, an adjustment mechanism is coupled to a perimeter edge of the second layer of material. Example adjustment mechanisms may comprise, for example, a magnetic tape having alternating and repeating magnetic elements configured to mate with a complementary magnetic tape having alternating and repeating magnetic elements that is coupled to a garment incorporating the apparel layer system. Other example adjustment mechanisms that may utilize complementary tapes where one tape is affixed to the second layer of material and the other tape is affixed to the garment may comprise hook-and-loop fasteners, button and button holes, snaps and sockets, hooks and eyes, and the like. Another adjustment mechanism contemplated herein may comprise a first set of slider elements coupled to the second layer of material and a second set of slider elements coupled to the garment. Yet another adjustment mechanism contemplated herein comprises a material portion coupled to the second layer of material and formed from yarns that undergo a shortening in length upon exposure to a stimulus. Any and all aspects, and any variation thereof, are contemplated as being within aspects herein.

Additional steps for the method 1300 may comprise incorporating the apparel layer system into a garment. In one example aspect used when the apparel layer system comprises a panel piece, the perimeter edges of at least the first layer of material and the second layer of material may be affixed to the garment. In another example aspect used when the first layer of material comprises a garment panel, the apparel layer system may be incorporated by affixing the second layer of material and the third layer of material to the first layer of material. Any and all aspects, and any variation thereof, are contemplated as being within aspects herein.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An apparel layer system comprising:

a first layer extending in a first planar direction;

a second layer extending in the first planar direction and movable between a first position and a second position based on a tension force in the first planar direction, wherein in the first position the second layer is spaced a first distance from the first layer and in the second position the second layer is spaced a second distance from the first layer, the second distance being larger than the first distance; and an adjustment mechanism comprising a first zipper element coupled to the first layer and a second zipper element coupled to the second layer, wherein the first zipper element and the second zipper element are decoupled when the second layer is in the first position and the first zipper element and the second zipper element are coupled when the second layer is in the second position.

2. The apparel layer system of claim 1 further comprising, a third layer positioned between and connected to the first layer and the second layer, wherein the third layer comprises a first portion coupled to the first layer, a second portion coupled to the second layer, and a panel extending between the first portion and the second portion.

3. The apparel layer system of claim 2, wherein the panel comprises a fold associated with the third layer and the first portion and the second portion comprise respective apexes.

4. The apparel layer system of claim 2, wherein the panel comprises a discrete panel and the first portion and the second portion comprise respective edges.

5. The apparel layer system of claim 2, wherein the third layer comprises a mesh material.

6. The apparel layer system of claim 2, wherein the third layer comprises apertures.

7. The apparel layer system of claim 2, wherein the third layer comprises a reflective deposit.

8. The apparel layer system of claim 1, wherein the first zipper element and the second zipper element are configured to releasably secure the apparel layer system in the second position.

9. The apparel layer system of claim 1, wherein the first layer includes a first set of apertures and the second layer includes a second set of apertures.

10. An apparel layer system comprising:

a first layer coupled to a first magnetic element and extending in a first planar direction;

a second layer coupled to a second magnetic element and extending in the first planar direction, wherein the second layer is movable between a first position and a second position based on a tension force in the first planar direction, wherein in the first position the second layer is spaced a first distance from the first layer and in the second position the second layer is spaced a second distance from the first layer, the second distance being larger than the first distance; and a third layer positioned between the first layer and the second layer, wherein the second magnetic element is configured to retain the second layer in the second position.

11. The apparel layer system of claim 10, wherein the third layer comprises a first portion coupled to the first layer, a second portion coupled to the second layer, and a panel extending between the first portion and the second portion.

12. The apparel layer system of claim 11, wherein the panel comprises a fold associated with the third layer and the first portion and the second portion comprise respective apexes.

13. The apparel layer system of claim 11, wherein the panel comprises a discrete panel and the first portion and the second portion comprise respective edges.

14. The apparel layer system of claim 11, wherein the third layer comprises a mesh material.

15. The apparel layer system of claim 11, wherein the third layer comprises apertures.

16. The apparel layer system of claim 11, wherein the third layer comprises a reflective deposit.

17. The apparel layer system of claim 10, wherein the first magnetic element is configured to slidably adjust relative to the second magnetic element when transitioning from the first arrangement to the second arrangement.

18. The apparel layer system of claim 10, wherein the first magnetic element and the second magnetic element comprise a respective series of magnets and each magnet in the series comprises an opposite polarity to one or more adjacent magnets in the series.

19. The apparel layer system of claim 10, wherein the first layer includes a first set of apertures and the second layer includes a second set of apertures.

* * * * *